US006662809B2

(12) United States Patent
Yamaguchi et al.

(10) Patent No.: US 6,662,809 B2
(45) Date of Patent: Dec. 16, 2003

(54) EYELASH CURLER

(75) Inventors: Naoki Yamaguchi, Hikone (JP); Kenichi Muraki, Hikone (JP); Hisasi Kitamura, Hikone (JP); Fumio Mihara, Hikone (JP)

(73) Assignee: Matsushita Electric Works, Ltd. (JP)

( * ) Notice: Subject to any disclaimer, the term of this patent is extended or adjusted under 35 U.S.C. 154(b) by 13 days.

(21) Appl. No.: 10/081,160

(22) Filed: Feb. 22, 2002

(65) Prior Publication Data

US 2002/0129829 A1 Sep. 19, 2002

(30) Foreign Application Priority Data

Feb. 23, 2001 (JP) ..... 2001-049176
Jun. 14, 2001 (JP) ..... 2001-180771

(51) Int. Cl.[7] ..... A45D 40/30
(52) U.S. Cl. ..... 132/217
(58) Field of Search ..... 132/217, 216, 132/218; 219/222, 223, 225, 227, 482, 490, 494

(56) References Cited

U.S. PATENT DOCUMENTS 2,444,937 A * 7/1948 Marcellus ..... 132/217
4,719,931 A * 1/1988 Suzuki ..... 132/217
5,097,598 A * 3/1992 Anfreula ..... 132/217
6,105,585 A * 8/2000 Thomas ..... 132/217

FOREIGN PATENT DOCUMENTS

JP U.M.3027148 5/1996 ..... A45D/2/48
JP 09-173130 7/1997 ..... A45D/2/48
JP U.M. 3060421 6/1999 ..... A45D/2/48
JP 190321 * 7/2001 ..... 132/217

OTHER PUBLICATIONS

Translation of Japanese Utility Model Publication, Publication No. U.M.3027148, Date of Publication May 15, 1996, 1 page.
Translation of Japanese Utility Model Publication, Publication No. U.M.3060421, Date of Publication Jun. 16, 1999 1 page.
Patent Abstracts of Japan, Publication No. 09–173130, Date of Publication Jul. 8, 1997, 1 page.

* cited by examiner

*Primary Examiner*—John J. Wilson
*Assistant Examiner*—Robyn Kieu Doan
(74) *Attorney, Agent, or Firm*—Rosenthal & Osha L.L.P.

(57) ABSTRACT

An eyelash curler that can selectively perform all-eyelashes curling and localized eyelashes curling is disclosed. The eyelash curler includes a curler main body, an immobilizing member attached to a top of the curler main body for immobilizing eyelashes, a plurality of first sandwiching-holding members attached to the curler main body underneath the immobilizing member and adapted to sandwich the eyelashes against the immobilizing member, and an operating handle attached to the curler main body for causing the plurality of first sandwiching-holding members to sandwich the eyelashes against the immobilizing member. By selecting a operation mode by a mode-switching switch, each of the plurality of first sandwiching-holding members can be independently pressed against and released from the immobilizing member so that a user can easily perform localized curling of the eyelashes.

24 Claims, 23 Drawing Sheets

EYELASH CURLER

BACKGROUND OF INVENTION

The present invention relates to an eyelash curler for performance of eyelash curling.

A conventional eyelash curler comprises one each of a respective immobilizing member which holds the eyelashes and a sandwiching-holding member which sandwiches the eyelashes against the immobilizing member. Although the all eyelashes may be curled in a single operation, such a conventional eyelash curler is unsuitable for curling eyelashes in a localized region such as at the inner or outer corner of the eye.

Moreover, although an eyelash curler is known for performance of localized eyelash curling, in order to use such an eyelash curler for localized curling at the inner or outer corner of the eye, eyelash curling must be performed repeatedly while this eyelash curler is gradually shifted. These repeated operations require both time and skill. Also if both all-eyelashes curling and localized curling are desired, multiple such eyelash curlers must be held and used differently according to the type of curling. This is also extremely troublesome for the user.

In consideration of the above mentioned circumstances, what is needed is to provide an eyelash curler that is readily operated by the user and is capable of selectively performing all-eyelashes or localized curling of eyelashes.

SUMMARY OF INVENTION

In general, in one aspect, the present invention is an eyelash curler that comprises a curler main body, an immobilizing member attached to a top of the curler main body for immobilizing eyelashes, a plurality of first sandwiching-holding members attached to the curler main body underneath the immobilizing member at a predetermined distance therefrom and adapted to sandwich the eyelashes against the immobilizing member, wherein each of the plurality of first sandwiching-holding members is positioned laterally adjacent to one another and independently pressed against and released from the immobilizing member, and an operating handle attached to the curler main body for causing the plurality of first sandwiching-holding members to sandwich the eyelashes against the immobilizing member.

In general, in one aspect, the present invention is an eyelash curler that comprises a curler main body, an immobilizing member attached to a top of the curler main body for immobilizing eyelashes, a plurality of first sandwiching-holding members attached to the curler main body underneath the immobilizing member at a predetermined distance therefrom and adapted to sandwich the eyelashes against the immobilizing member, wherein each of the plurality of first sandwiching-holding members is positioned laterally adjacent to one another and independently pressed against and released from the immobilizing member, and a plurality of operating handles for causing the plurality of first sandwiching-holding members to sandwich the eyelashes against the immobilizing member. Each of the plurality of operation handles causes a different first sandwiching-holding member to sandwich the eyelashes against the immobilizing member independently.

BRIEF DESCRIPTION OF DRAWINGS

FIG. 1(*b*) is a side view of an eyelash curler according to an embodiment of the present invention.

FIG. 1(*c*) is a rear view of an eyelash curler according to an embodiment of the present invention.

FIG. 16(*b*) is a side view of an eyelash curler according to an embodiment of the present invention.

FIG. 16(*c*) is a side view of an eyelash curler according to an embodiment of the present invention.

FIG. 17(*b*) is a side view of an eyelash curler according to another embodiment of the present invention.

FIG. 17(*c*) is a rear view of an eyelash curler according to another embodiment of the present invention.

FIG. 22(*b*) shows a state of the eyelash curler shown in FIG. 16(*a*) where both the left first sandwiching-holding member and the left second sandwiching holding member are pressed against the immobilizing member.

DETAILED DESCRIPTION

Figures 1A, 1B, 1C:
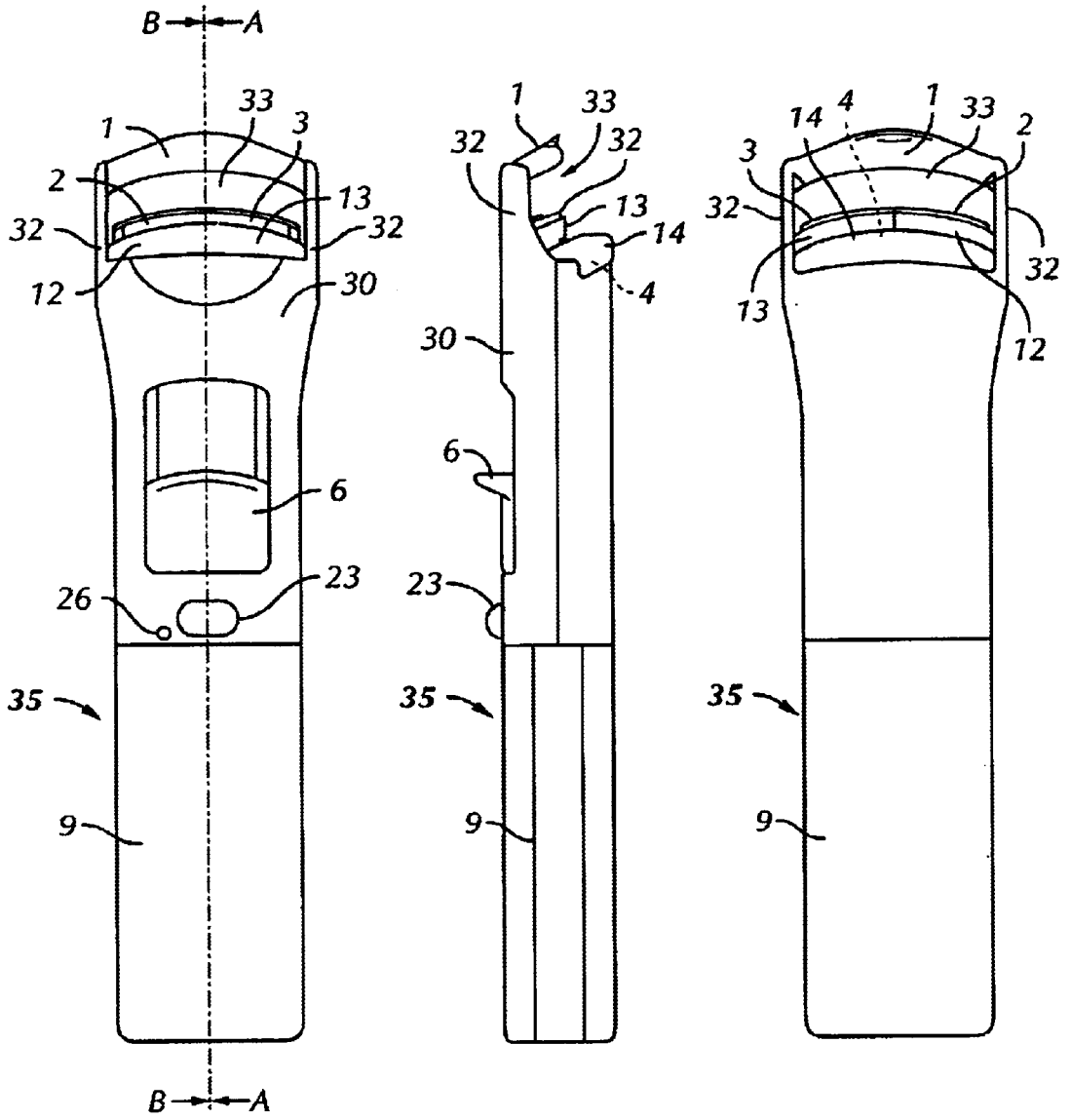
FIG. 1(*a*) is a front view of an eyelash curler according to an embodiment of the present invention.

Referring now to the drawings wherein like reference characters are used for like parts throughout the several views, the present invention is explained in detail as follows. In the following descriptions, right-left and top-down directions are defined as seen from the user side during eyelash curling as shown in FIG. 1(*a*) or FIG. 16(*a*).

First, an eyelash curler 35 shown in FIG. 1–FIG. 15, which is an embodiment of the present invention, will be described. FIGS. 1(*a*)–(*c*) show the entire body of the eyelash curler 35. The eyelash curler 35 comprises a curler main body 30 equipped with an immobilizing member 1 for holding eyelashes from one direction, a left first sandwiching-holding member 2 and a right first sandwiching-holding member 3 for contacting and separating relative to the immobilizing member 1 for sandwiching eyelashes from the hair base to the hair intermediate part, a second sandwiching-holding member 4 for sandwiching the eyelashes from the hair intermediate part to the hair tip against the immobilizing member 1, and an operating handle 6 for moving this left first sandwiching-holding member 2, the right first sandwiching-holding member 3, and the second sandwiching-holding member 4. The operating handle 6 is constructed so as to freely slide vertically at the front side of the eyelash curler main body 30. Moreover, a battery cover 9 formed in a slender shape extending toward vertical direction is connected to the bottom part of the eyelash curler main body 30.

At the upper part of both sides of the eyelash curler main body 30, support columns 32 are provided in a manner that they protrude upward from the eyelash curler main body 30. Since the immobilizing member 1 is provided so as to hang between both support columns 32, a window 33 is formed in a manner that it is surrounded by the top of the eyelash curler main body 30, both support columns 32, and immobilizing member 1. The immobilizing member 1 is curved similarly to the curvature of the eyeball. Viewing from the front, the central part of the immobilizing member 1 curves upward, and viewing from the top, the central part of the immobilizing member 1 curves toward the back.

The left first sandwiching-holding member 2 is attached to the upper tip of the left first holder 12 and the adjacent right first sandwiching-holding member 3 is attached to the upper tip of a right first holder 13 so as to have right-left symmetry. Also, the second sandwiching-holding member 4 is provided attached to the upper tip of a second holder 14. This left first holder 12 and the right first holder 13 move vertically and independently of each other. The left first sandwiching-holding member 2, the right sandwiching-holding member 3, and the second sandwiching-holding member 4 each protrude into the window 33 from a top opening of the eyelash curler main body 30. Due to upward movement of the left first holder 12, the right first holder 13, and the second holder 14, the left first sandwiching-holding member 2, the right first sandwiching-holding member 3, and the second sandwiching-holding member 4 each rise within the window 33 toward the immobilizing member 1 so as to press against the immobilizing member 1. As seen from the right side, the second sandwiching-holding member 4 is displaced toward the back (rightward in FIG. 1(*b*)) relative to the left first sandwiching-holding member 2 and the right first sandwiching-holding member 3.

The left first sandwiching-holding member 2 and the right first sandwiching-holding member 3 are both curved with a curvature resembling that of the eyeball and matching the curvature of the immobilizing member 1. That is to say, the central part curves upward as viewed from the front, and the central part curves toward the back as viewed from the top. Therefore, when the immobilizing member 1 curved in this manner is in contact with the eyelid, it is positioned upon the eyelashes, and the eyelashes from the hair base to the hair intermediate part are sandwiched by this immobilizing member 1 and the above left and right first sandwiching-holding members 2 and 3. Moreover, the second sandwiching-holding member 4 is also curved to match the immobilizing member 1. The center part of the second sandwiching-holding member 4 curves upward as viewed from the front and curves toward the back as viewed from the top. Therefore, the hair tip end part from the hair intermediate part to the hair tip becomes sandwiched between the second sandwiching-holding member 4 and the back-surface side of the immobilizing member 1.

Figure 3:
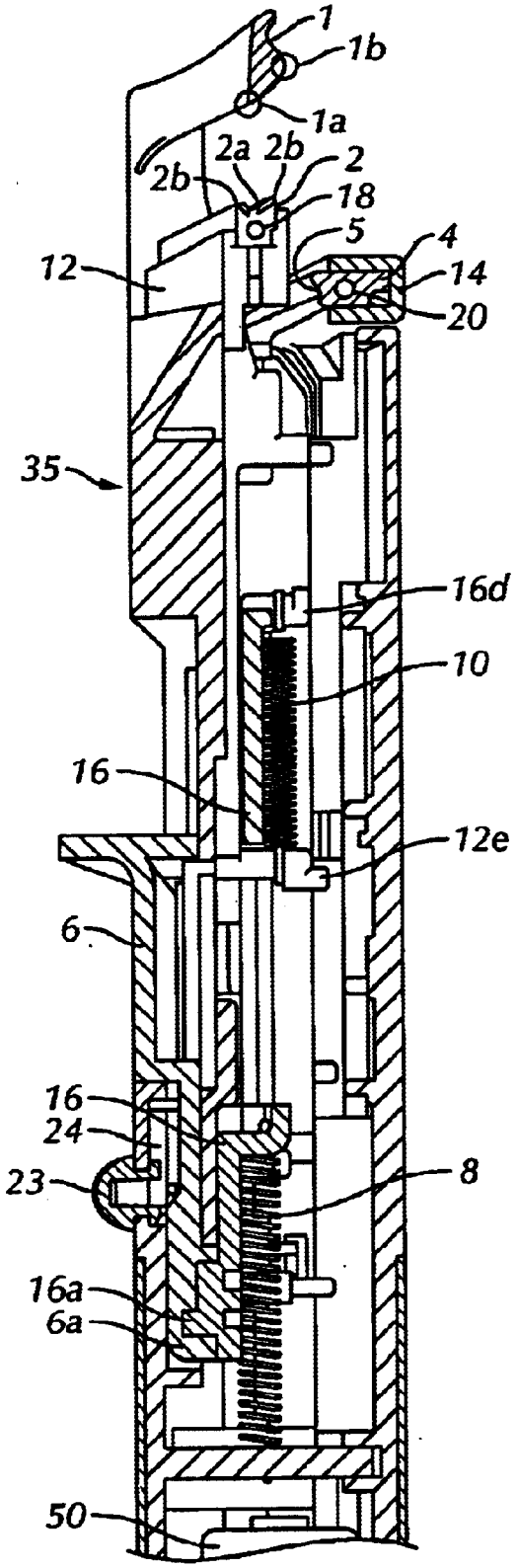
FIG. 3 is a cross-sectional view of an eyelash curler shown in FIG. 1(*a*) cut by A—A line.
Figure 4:
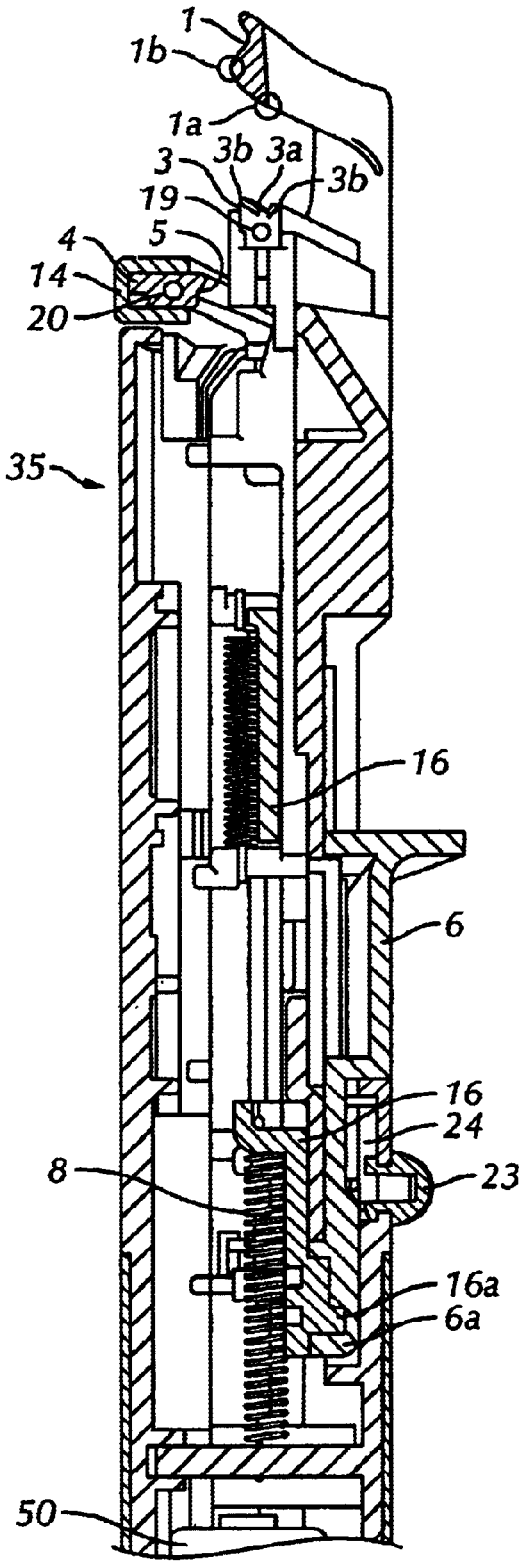
FIG. 4 is a cross-sectional view of an eyelash curler shown in FIG. 1(*a*) cut by B—B line.

As shown in FIG. 3 and FIG. 4, the left first sandwiching-holding member 2 and the right first sandwiching-holding member 3 are respectively provided with a groove 2*a* and a groove 3*a* with V-shaped cross section that are laterally continuous when the left first sandwiching-holding member 2 and the right first sandwiching-holding member 3 are lined up. These grooves 2*a* and 3*a* fit into a protuberance 1*a* formed at the bottom of the immobilizing member 1. By this means, the eyelash is curled from the hair base part to the hair intermediate part of the eyelashes by sandwiching between the protuberance 1*a* and the grooves 2*a* and 3*a* of the left first sandwiching-holding member 2 and the right first sandwiching-holding member 3. Here, the V-shaped grooves 2*a* and 3*a* have rounded groove bottoms rather than acute angles so that a rounded curl can be imparted to the eyelashes along the grooves 2*a* and 3*a* without imparting an acute-angle shape. The second-holding member 4 is provided with a groove 5 having a V-shape cross-section. A protuberance 1*b* is formed at the back-surface side of the immobilizing member 1 to engage with this groove 5. Therefore, curling the eyelashes from the hair intermediate part to the hair tip occurs due to sandwiching of the eyelashes from the hair intermediate part to the hair tip between the groove 5 of the second sandwiching-holding member 4 and the protuberance 1*b*. The bottom of this groove 5 may also be formed rounded without an acute angle.

Here, the immobilizing member 1 may be formed from a rigid material such as metal, plastic, or the like. Also, the left first sandwiching-holding member 2, the right first sandwiching-holding member 3, and the second sandwiching-holding member 4 may be formed from elastic material. Under this configuration, it becomes possible to increase pressure of the eyelashes against the immobilizing member 1 and to more readily curl the eyelashes.

A thin-walled left protuberance 2*b* formed from elastic material is provided on the left first sandwiching-holding member 2 extending from the side facing the adjacent right first sandwiching-holding member 3, and a right protuberance 3*b* is provided in the same manner on the right first sandwiching-holding member 3 extending from the right first sandwiching-holding member 3 toward the left first sandwiching-holding member 2. The face of the left protuberance 2*b* and the right protuberance 3*b* at the immobilizing member 1 side is formed in a manner that the face which extends to connect the contacting surface of the left first sandwiching-holding member 2 and the contacting surface of the right first sandwiching-holding member 3 is divided right-left into two parts so that eyelashes are not caught in the gap between the left protuberance 2*b* and the right protuberance 3*b*.

The left first sandwiching-holding member 2 contains internally a left first heater 18 formed from a coil-shaped nichrome. The right first sandwiching-holding member 3 contains a right first heater 19 in the same manner. Moreover, the second sandwiching-holding member 4 internally contains a second heater 20 formed from a coil-shaped nichrome wire. A dry cell battery 50 contained within the eyelash curler main body 30 is connected to this left first heater 18, the right first heater 19, and the second heater 20 so that eyelashes can be readily and dependably curled by heating. A current ON lamp 26 is provided at the front side of the eyelash curler main body 30 to indicate by light emission that at least one of the left first heater 18 and the right first heater 19. Color of the emitted light varies depending upon which heater (i.e., the left first heater 18 or the right first heater 19) current flows through, and intensity of the emitted light decreases as voltage drops for the power supply providing this current.

Next, another embodiment that contacts and separates the left first sandwiching-holding member 2 and the right first sandwiching-holding member 3 together or alone in accompaniment with the operation of operating handle 6 of the eyelash curler 35 is explained.

Figure 2:
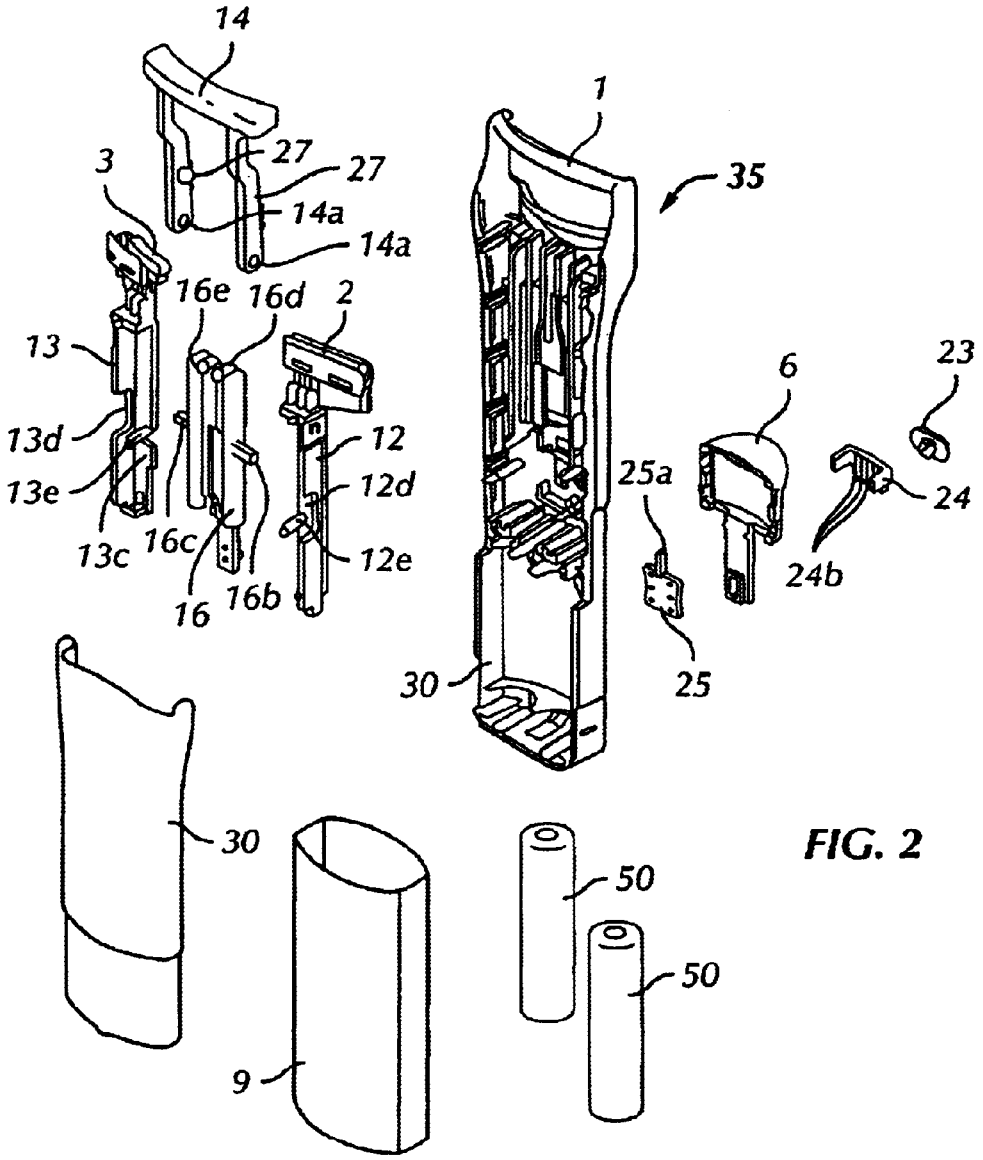
FIG. 2 is a disassembled view of an eyelash curler according to an embodiment of the present invention.
Figure 5:
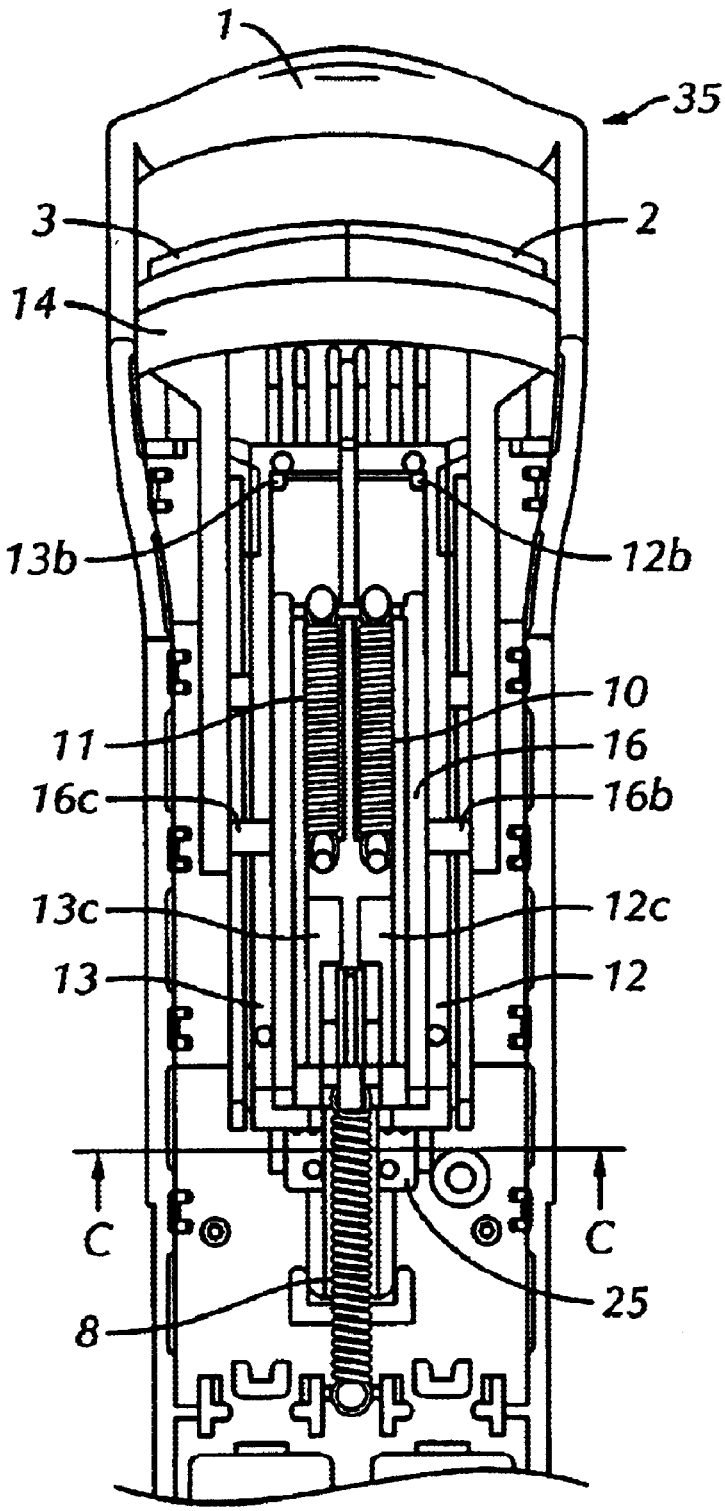
FIG. 5 is a rear view of an eyelash curler shown in FIG. 1(*a*) from which part of the cover has been removed.
Figure 6:
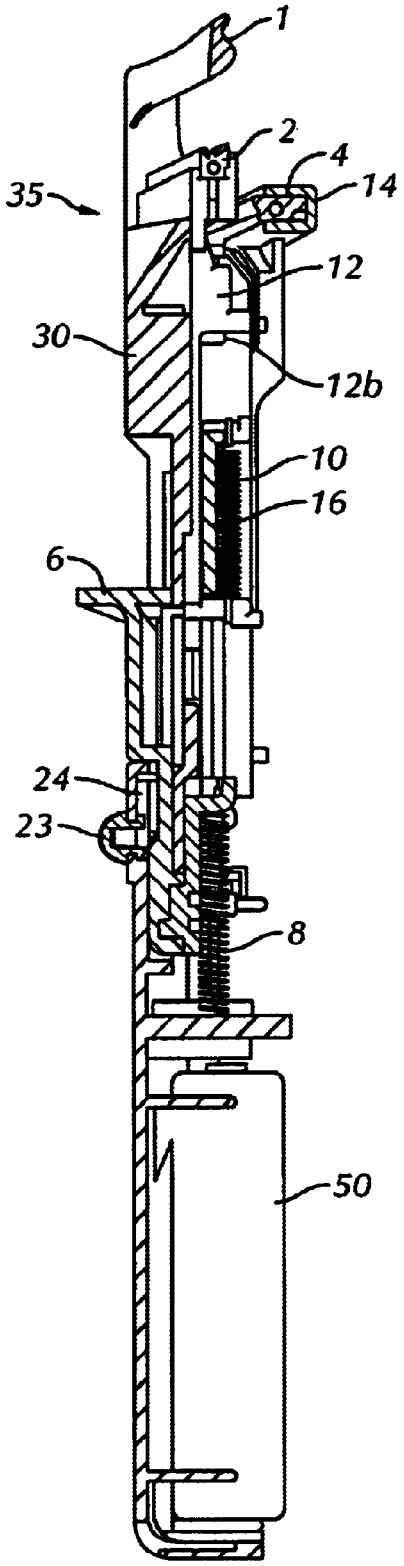
FIG. 6 is a cross-sectional view of an eyelash curler shown in FIG. 1(*a*) from which part of the cover has been removed and cut by A—A line.

As shown in FIG. 2 and FIG. 5, a slide knob 16 is contained within the space surrounded by the left first holder 12 and the right first holder 13 inside the eyelash curler main body 30. As shown in FIG. 3 and FIG. 4, a joint 16*a* provided on a slide knob 16 engages with a protuberance 6*a* provided on the operating handle 6. The slide knob 16 moves vertically freely in accompaniment with vertical sliding of the operating handle 6. A first spring 8 connects the bottom of the slide knob 16 and the eyelash curler case body 30 so as to retain initial tension. Moreover, a left lateral tab 16*b* and a right lateral tab 16*c* are provided protruding from the approximate center of the left and right side faces of the slide knob 16. The left lateral tab 16*b* of the slide knob 16 is inserted into a left aperture 12*d* provided in the approximate center of the left side-wall of the left first holder 12 so as to move vertically freely, and the right lateral tab 16*c* of the slide knob 16 is inserted into a right aperture 13*d* provided in the approximate center of the right side-wall of the right first holder 13 so as to move vertically freely.

As illustrated in FIGS. 2 and 5, a left second spring 10 connects a left upper protuberance 16*d* provided above the left lateral tab 16*b* of the slide knob 16 to a left lower protuberance 12*e* provided below the left aperture 12*d* of the left first holder 12. A right second spring 11 connects a right upper protuberance 16*e* provided on the right and adjacent to the left upper protuberance 16*d* and a right lower protuberance 13*e* provided below the right aperture 13*d* of the right first holder 13. The first spring 8, the left second spring 10, and the right second spring 11 may be constructed from any elastic material such as rubber, etc. that has initial tension. Respective through-holes 14*a* are provided through arms 27. The arms 27 are provided such that they extend downward from both sides of the second holder 14. The left lateral tab 16*b* and the right lateral tab 16*c* fit together with these through-holes 14*a* so as to connect together the second holder 14 and the slide knob 16.

Figure 7:
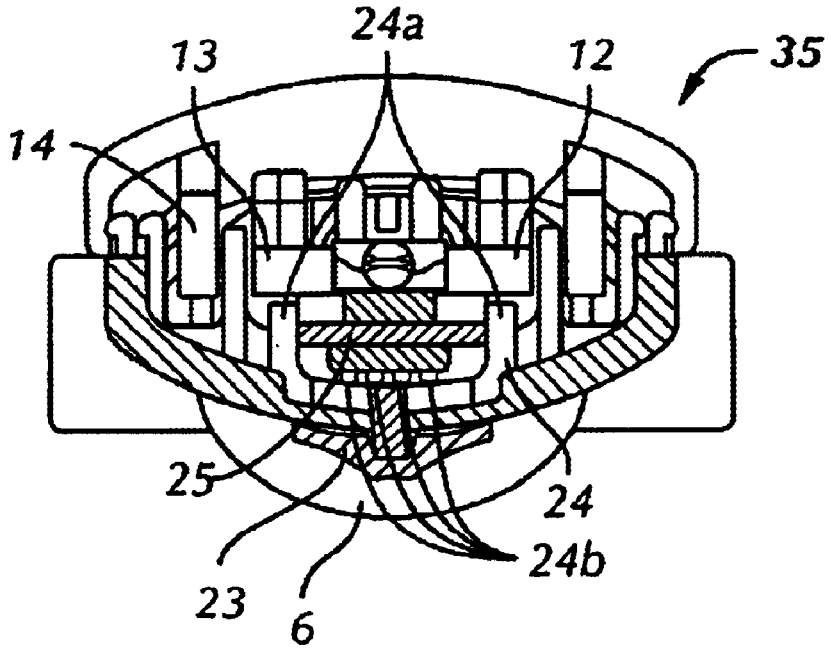
FIG. 7 is a cross-sectional view of an eyelash curler shown in FIG. 5 cut by C—C line.

As shown in FIG. 7, a left-right-freely-switchable mode-switching switch 23 provided below the operating handle 6 is connected to a mode-switching stopper 24 contained in the eyelash curler main body 30 so that this mode-switching stopper 24 moves left and right in response to movement of the mode-switching switch 23. Moreover, a lock plate 25 is also connected to the operating handle 6 and moves left and right in response to sliding of the mode-switching stopper 24 (i.e., sliding of the mode-switching switch 23).

FIG. 1 and FIG. 3–FIG. 11 show the mode-switching switch 23 positioned at the center of the right-left sliding range. When the operating handle 6 is slid upward while the mode-switching switch 23 is in this state, the slide knob 16 moves upward so that the left first holder 12 and the right first holder 13 are raised via the left second spring 10 and the right second spring 11, and the left first sandwiching-holding member 2 and the right second sandwiching-holding member 3 attached to the upper tip of the left first holder 12 and the right first holder 13 are pressed against the bottom side of the immobilizing member 1, holding the eyelashes at their hair base part past the hair intermediate part. Moreover, since the slide knob 16 and the second holder 14 are connected as explained previously, such upward movement of the operating handle 6 also causes accompanying upward movement of the second holder 14.

Figure 8:
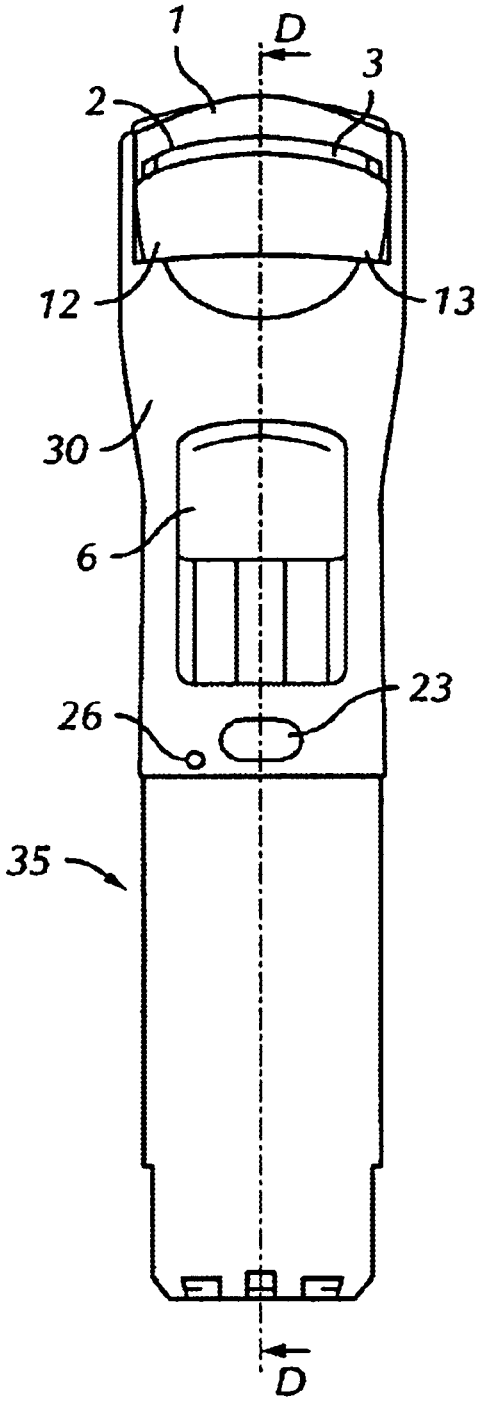
FIG. 8 is a front view of an embodiment of an eyelash curler of the present invention equipped with a mode-switching switch wherein the operating handle is toggled toward the highest position.
Figure 9:
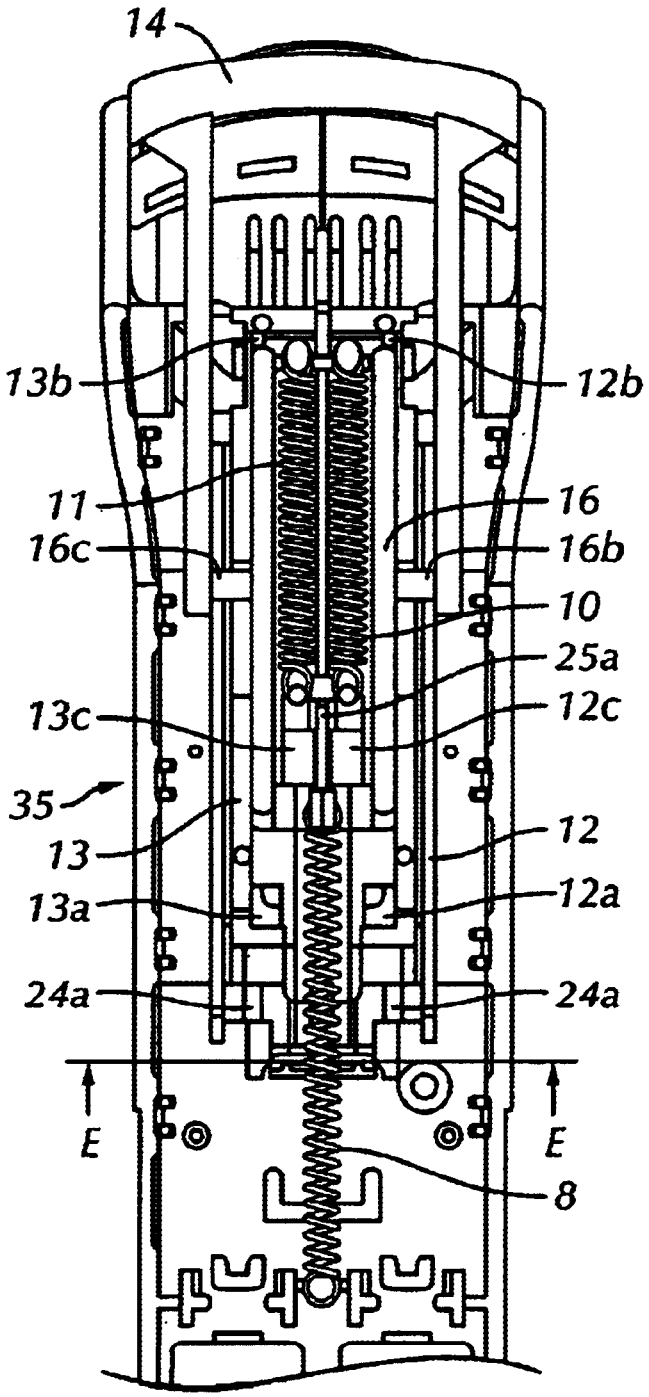
FIG. 9 is a rear view of an embodiment of an eyelash curler of the present invention shown in FIG. 8 from which part of the cover has been removed.
Figure 10:
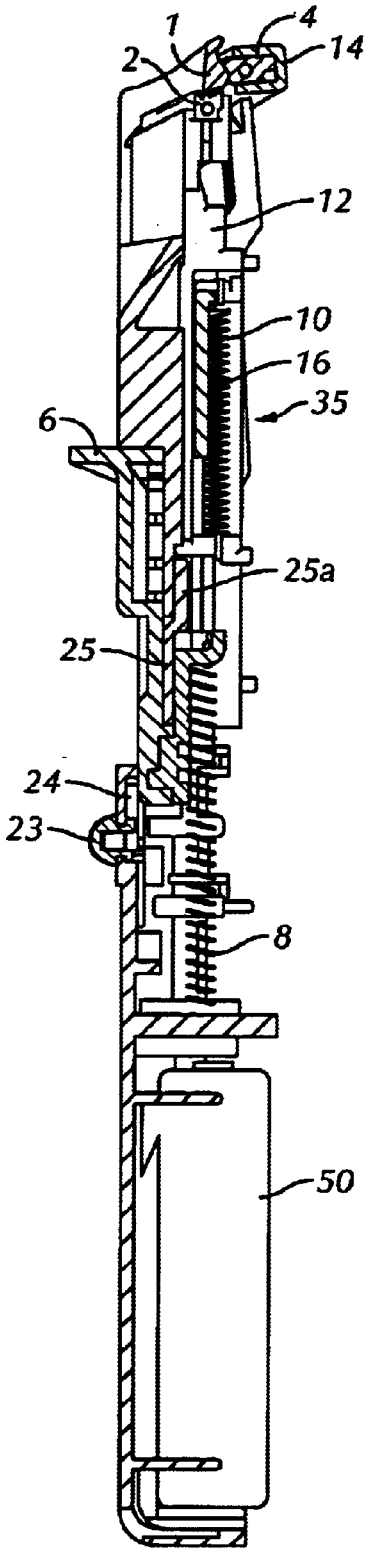
FIG. 10 is a cross-sectional view of the eyelash curler shown in FIG. 8 from which the cover has been removed.
Figure 11:
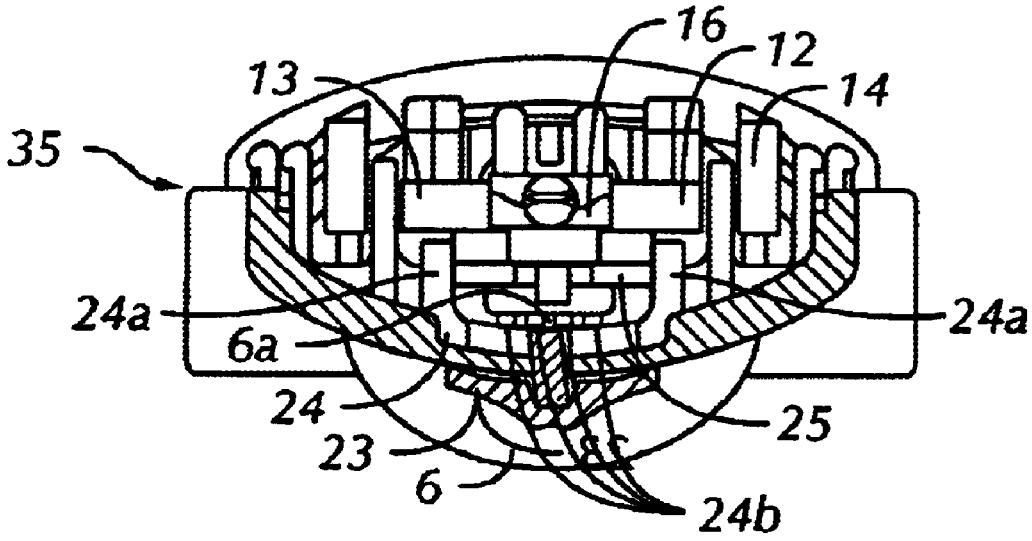
FIG. 11 is a cross sectional view of the eyelash curler shown in FIG. 9 cut by E—E line.
Figure 12:
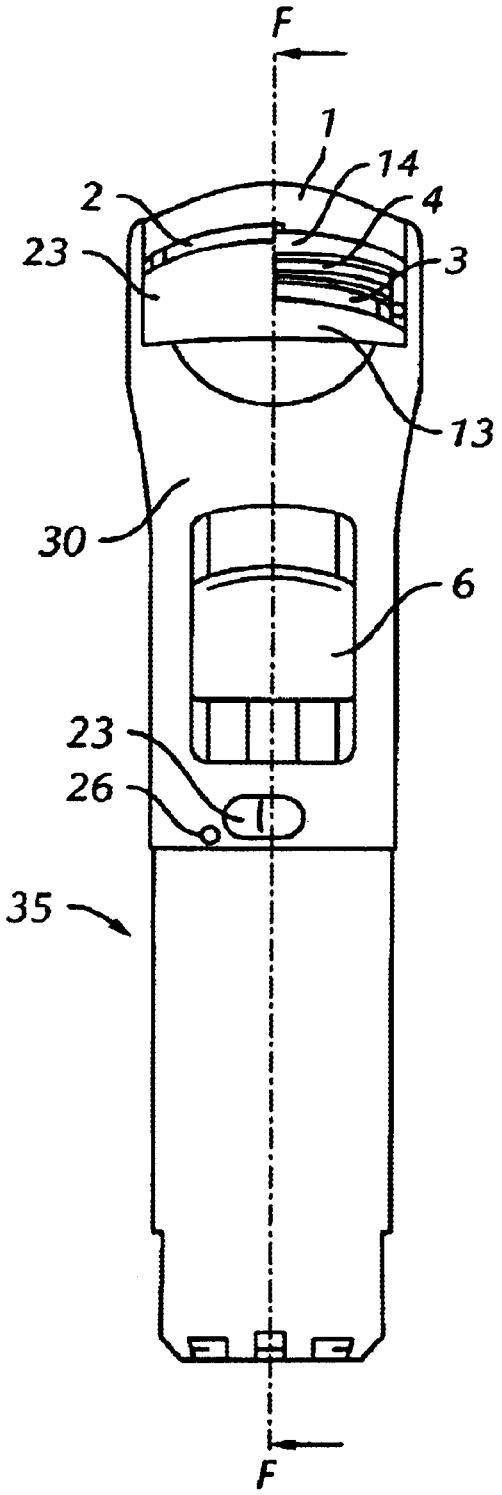
FIG. 12 is a front view of an embodiment of the eyelash curler according to the present invention curler equipped with a mode-switching switch at the left side thereon while the operating handle is moved toward the highest position.

Here, within the movement range of the operating handle 6 from the initial state shown in FIG. 1 and FIG. 3–FIG. 7 until the eyelashes are sandwiched and held from the hair base part to the hair intermediate part by pressing of the left first sandwiching-holding member 2 and the right first sandwiching-holding member 3 against the immobilizing member 1, the left first sandwiching-holding member 2, the right first sandwiching-holding member 3, and the second sandwiching-holding member 4 move in concert upward. When raising the operating handle 6 beyond the movement range after the left and right first sandwiching-holding members 2 and 3 are pushed against the immobilizing member 1, the second holder 14 connected to the slide knob 16 is raised further opposing the left and right second springs 10 and 11 while the eyelashes from the hair base part to the hair intermediate part are held between the left and right first sandwiching-holding members 2 and 3 and the immobilizing member 1 by the tension of the spring 10 and right second spring 11. Therefore, within a region exceeding a certain range, only the second sandwiching-holding member 4 moves, and as shown in FIG. 8–FIG. 10, the second sandwiching-holding member 4 further presses the hair tip end part of the eyelash from the hair intermediate part to the hair tip protruding from the part sandwiched between the left first sandwiching-holding member 2 and the right sandwiching-holding member 3 and the immobilizing member 1 toward the back side of the immobilizing member 1. Curling can be carried out in this manner from the hair base part to the hair tip of the eyelashes.

Since the first spring 8, the left second spring 10, and the right second spring 11 in the above mentioned manner maintain initial tension, the left first sandwiching-holding member 2, the right first sandwiching-holding member 3, and the second sandwiching-holding member 4 automatically separate from the immobilizing member 1 when the finger separates from the operating handle 6, so that operability is good for the user. In this manner, it is possible for eyelash curling to be smoothly carried out by the user grasping a grip 9 of the eyelash curler main body 30 by hand, pressing the operating handle 6 upward, and then just releasing the finger from the operating handle 6.

Figure 13:
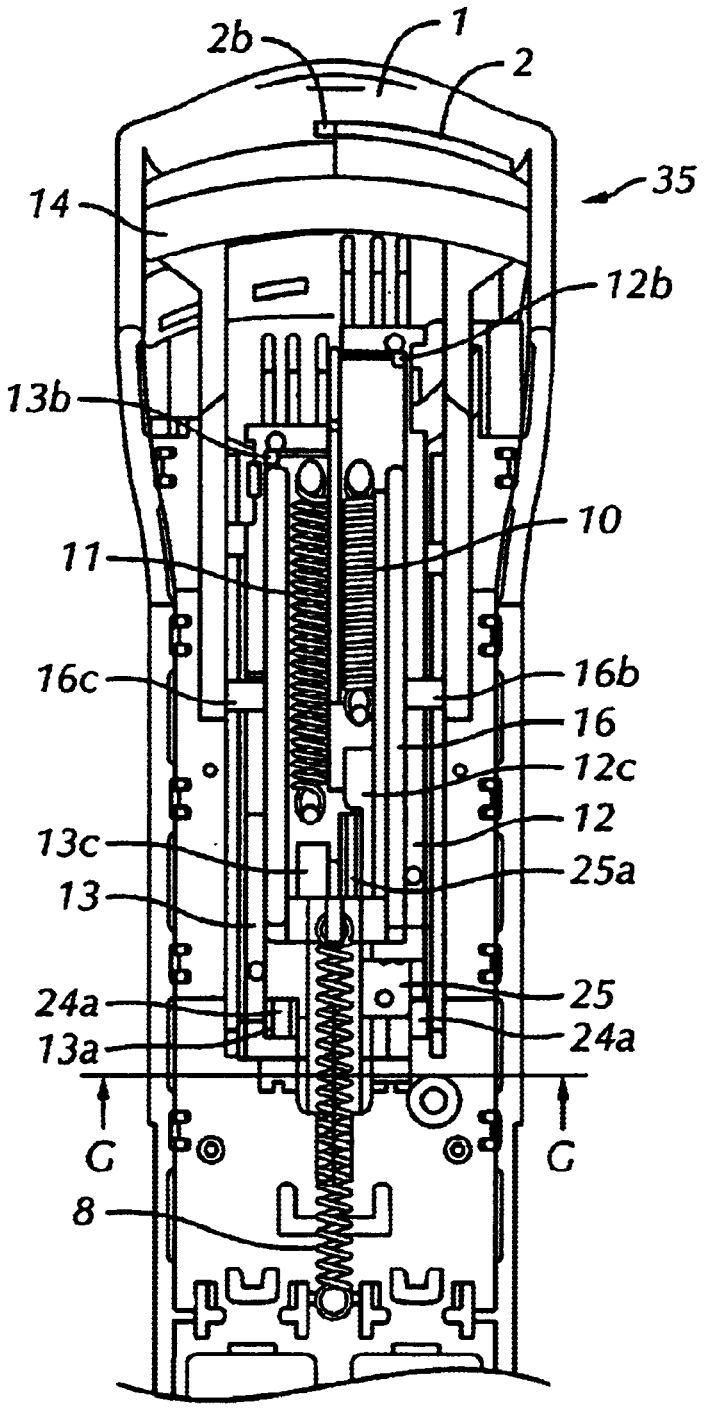
FIG. 13 is a rear view of the eyelash curler shown in FIG. 12 from which part of the cover has been removed.
Figure 14:
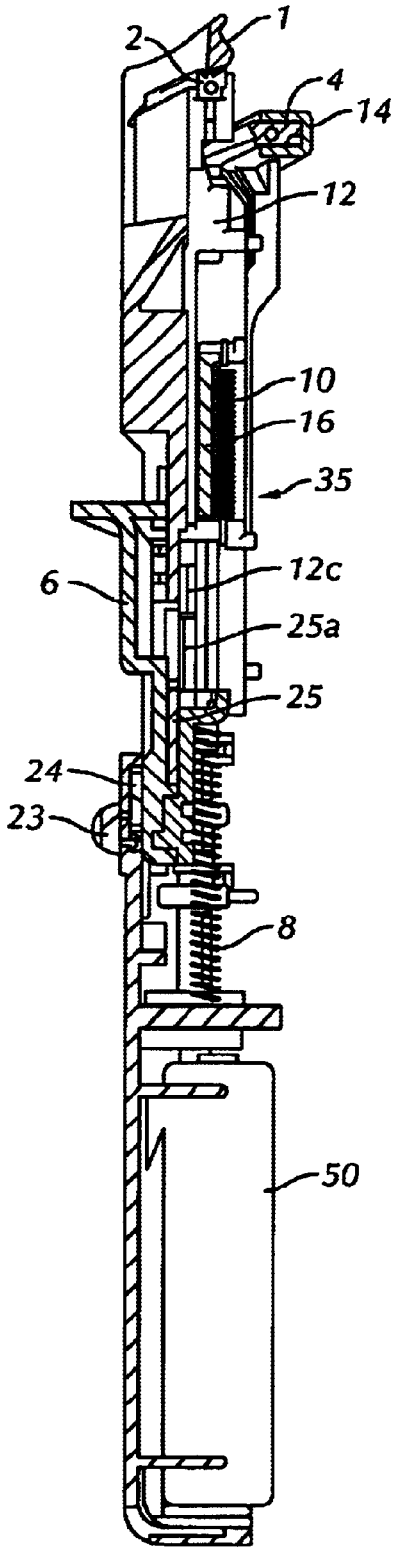
FIG. 14 is a cross-sectional view of the eyelash curler shown in FIG. 12 from which part of the cover has been removed and cut by F—F line.
Figure 15:
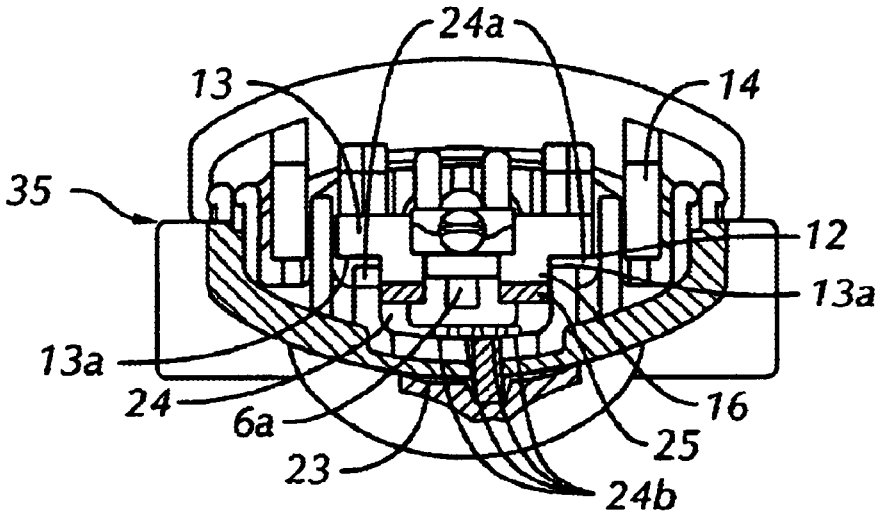
FIG. 15 is a view of the G—G cross section of FIG. 13.

FIG. 12–FIG. 15 show the mode-switching switch 23 positioned at the left side within the right-left sliding range. When the operating handle 6 is slid upward in this state, upward movement of the slide knob 16 causes concerted movement of the left first holder 12 connected to the slide knob 16 through the left second spring 10 and the second holder 14 connected to the slide knob 16 through the left lateral tab 16*b* and the right lateral tab 16*c*. At this time as shown in FIG. 13 and FIG. 15, a right concavity 13*a* provided in the lower part of the right first holder 13 fits together with the right-side tips of a pair of protuberances 24*a* provided on the mode-switching stopper 24, which has slid to the left in response to movement of the mode-switching switch 23. Therefore, even if upward movement of the slide knob 13 in response to movement of connected the operating handle 6 occurs, the right first holder 13 does not operate and remains fixed in a position displaced from the immobilizing member 1. When the left first holder 12 is moved to a certain position, the left first sandwiching-holding member 2 attached to the upper tip of the left first holder 12 is pressed downward against the immobilizing member 1 over the base part to the intermediate part of the eyelashes.

A right protuberance 13*b* protrudes at the upper part of the right first holder 13 fixed in this manner. While the left first sandwiching-holding member 2 pressed upward by the operating handle 6 presses against the lower side of the immobilizing member 1 from the hair base part to the hair intermediate part of the eyelashes, the right side upper tip of the slide knob 16 contacts the above mentioned right protuberance 13*b* so that the slide knob 16 is not pressed upward beyond this range. Because movement of the second holder 14 connected to slide knob 16 is halted at this position, movement of the second sandwiching-holding member 4 is halted at a position that leaves an appropriate gap therebetween so that clear recognition of movement of the left first sandwiching-holding member 2 through the window 33 becomes possible.

Also, at this time, a left joint stop 12*c* provided protruding from the right edge of the left second holder 12 fits together with a locking protuberance 25*a* provided on the lock plate 25 which moves upward linked to the operating handle 6 in response to leftward sliding movement of the mode-switching switch 13. Due to this engagement of the left joint stop 12*c* and the locking protuberance 25*a,* the left first sandwiching-holding member 12 is fixed at this position so that curling of eyelashes can be dependably carried out when pressed against the immobilizing member 1.

As shown in FIG. 15, a protuberance 6*a* protrudes from the front face at the lower part of operating handle 6. When the operating handle 6 is pushed up, the above mentioned protuberance 6*a* engages with the four backside protuberances provided in proximity to one another in a row along the right-left direction on the backside of the mode-switching stopper 24. By this means, the mode-switching switch 23 linked to the mode-switching stopper 24 is prevented from sliding to the left or right during performance of contact and separation of the left first sandwiching-holding member 2.

Next, operation will be explained when the mode-switching switch 23 is positioned at the right end of the right-left sliding range thereof. As shown in FIG. 9, the eyelash curler 35 of the present embodiment has right-left symmetry. Therefore, a left concavity 12*a* and a left protuberance 12*b* are provided on the left first holder 12 in the same manner as for the right first holder 13, and a right joint stop 13*c* is provided in the right first holder 13 in the same manner as for the left first holder 12. Therefore, in the same manner as during leftward positioning of the mode-switching switch 23, when the operating handle 6 is slid upward, the left first holder 13 and the second holder 14 operate and move in concert, and movement of the second holder 14 is halted when the right first sandwiching-holding member 3 pushed against the lower side of the immobilizing member 1 from the hair base part to the hair intermediate part of the eyelashes. Then, movement of the left first holder 12 is halted at a position separated from the immobilizing member 1. In addition, while the right first sandwiching-holding member 3 is in contact with the immobilizing member 1, the right first sandwiching-holding member 3 is fixed so that the eyelashes are dependably held, and the mode-switching switch 23 is fixed so that right-left sliding does not occur during performance of contact and separation of the right first sandwiching-holding member 3.

By using the eyelash curler 35 of the present embodiment in this manner, it becomes possible to perform localized curling of the part of the eyelashes sandwiched between the left first sandwiching-holding member 2 and the immobilizing member 1 by sliding the mode-switching switch 23 leftward. Also, by sliding the mode-switching switch 23 rightward, it becomes possible to perform localized curling of the part of the eyelashes sandwiched between the right first sandwiching-holding member 3 and the immobilizing member 1. Further, by sliding the mode-switching switch 23 at a central position, it becomes possible to perform all-eyelashes curling of the eyelashes sandwiched between the left first sandwiching-holding member 2 and the right first sandwiching-holding member 3 and the immobilizing member 1.

A first sandwiching-holding member may be segmented laterally into three or more parts rather than segmented into two parts as in the case of the present embodiment. In that case, it is preferable that operation range of the mode-switching switch 23 for carrying out the selection of the first sandwiching-holding member that contacts/separates relative to the immobilizing member 1 is multiply segmented in the same manner as the first sandwiching-holding member. It is also preferable that the first sandwiching-holding member segment (e.g., a segment at second-from-the-left) be at a position that corresponds to the divided operation range of the mode-switching switch 23 carries out contact and separation relative to the immobilizing member 1.

Figures 16A, 16B, 16C:
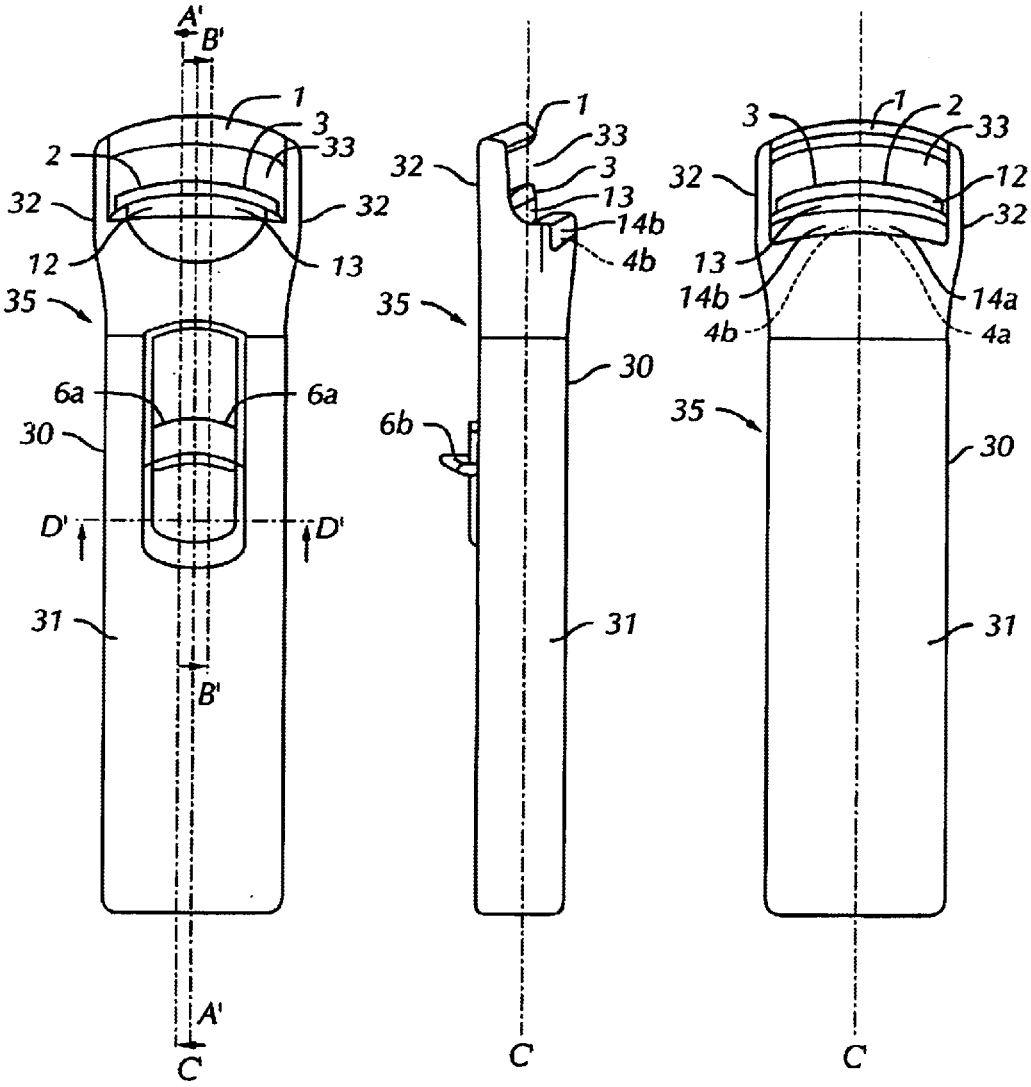
FIG. 16(*a*) is a front view of an eyelash curler according to an embodiment of the present invention.

Next, another embodiment of the eyelash curler 35 of the present invention will be described while referring to FIG. 16–FIG. 23. As shown in FIG. 16, this another embodiment of the eyelash curler 35 comprises the immobilizing member 1 which holds one end portion of the eyelashes, the left first sandwiching-holding member 2 and the right first sandwiching-holding member 3 which freely contact and separate relative to the immobilizing member 1 for sandwiching the eyelashes against immobilizing member 1, a left second sandwiching-holding member 4*a* and a right second sandwiching-holding member 4*b* for sandwiching the eyelashes from the hair intermediate part to the hair tip against the immobilizing member 1, a left operating handle 6*a* for moving the left first sandwiching-holding member 2 and the left second sandwiching-holding member 4*a,* and a right operating handle 6*b* for moving the right first sandwiching-holding member 3 and the right second sandwiching-holding member 4*b*. These components are provided in a manner that they are divided with right-left symmetry centered upon centerline C'.

The eyelash curler main body 30 comprises a vertically elongated grip 31 so that the eyelash curler main body 30 can be easily gripped by hand. The independently vertically movable left operating handle 6*a* and the right operating handle 6*b* are provided side by side divided by, and with right-left symmetry around, centerline C'. At the upper part of both sides of the eyelash curler main body 30, support columns 32 are provided in a manner that they protrude upward from the eyelash curler main body 30. Since the immobilizing member 1 is provided so as to hang between both support columns 32, a window 33 is formed in a manner that it is surrounded by the top of the eyelash curler main body 30, both support columns 32, and immobilizing member 1. The immobilizing member 1 is curved similarly to the curvature of the eyeball. Viewing from the front, the central part of the immobilizing member 1 curves upward, and viewing from the top, the central part of the immobilizing member 1 curves toward the back.

The left first sandwiching-holding member 2 is attached to the upper tip of the left first holder 12, and the adjacent right first sandwiching-holding member 3 is attached to the upper tip of the right first holder 13 so as to have right-left symmetry. Also with right-left symmetry, the left second sandwiching-holding member 4*a* is provided attached to the upper tip of the left second holder 14*a,* and the right second sandwiching-holding member 4*b* is provided attached to the upper tip of right second holder 14*b*. The above mentioned right first holder 12, the left first holder 13, the right second holder 14*a,* and the left second holder 14*b* move vertically freely with respective right-left independence. The left first sandwiching-holding member 2, the right sandwiching-holding member 3, the left second sandwiching-holding member 4*a,* and the right second sandwiching-holding member 4*b* each protrudes into the window 33 from a top opening of the eyelash curler main body 30. By moving the left first holder 12, the right first holder 13, the left second holder 14*a,* and the right second holder 14*b* upward, the left first sandwiching-holding member 2, the right first sandwiching-holding member 3, the left second sandwiching-holding member 4*a,* and the right second sandwiching-holding member 4*b* are moved upward within the window 33 toward the immobilizing member 1 so as to press against the immobilizing member 1. Here, the left second sandwiching-holding member 4*a* and the right second sandwiching-holding member 4*b* are displaced toward the back (right side of FIG. 16(*b*), FIG. 17(*b*)) relative to the left first sandwiching-holding member 2 and the right first sandwiching-holding member 3.

The left first sandwiching-holding member 2 and the right first sandwiching-holding member 3 are both curved with a curvature resembling that of the eyeball and matching the curvature of the immobilizing member 1. That is to say, the central part curves upward as viewed from the front, and the central part curves toward the back as viewed from the top. Therefore, when the immobilizing member 1 curved in this manner is in contact with the eyelid, it is positioned upon the eyelashes, and the eyelashes from the hair base part to the hair intermediate part are sandwiched by this immobilizing member 1 and the above left first sandwiching-holding members 2 and 3. In addition, the left second sandwiching-holding member 4*a* and the right second sandwiching-holding member 4*b* are also curved to match immobilizing member 1. The center parts of the left second sandwiching-holding member 4*a* and the right second sandwiching-holding member 4*b* curve upward as viewed from the front and curve toward the back as viewed from the top. Therefore, the hair tip end part from the hair intermediate part to the hair tip becomes sandwiched between the left second sandwiching-holding member 4*a,* the right second sandwiching-holding member 4*b* and the back-surface side of the immobilizing member 1.

Figure 19:
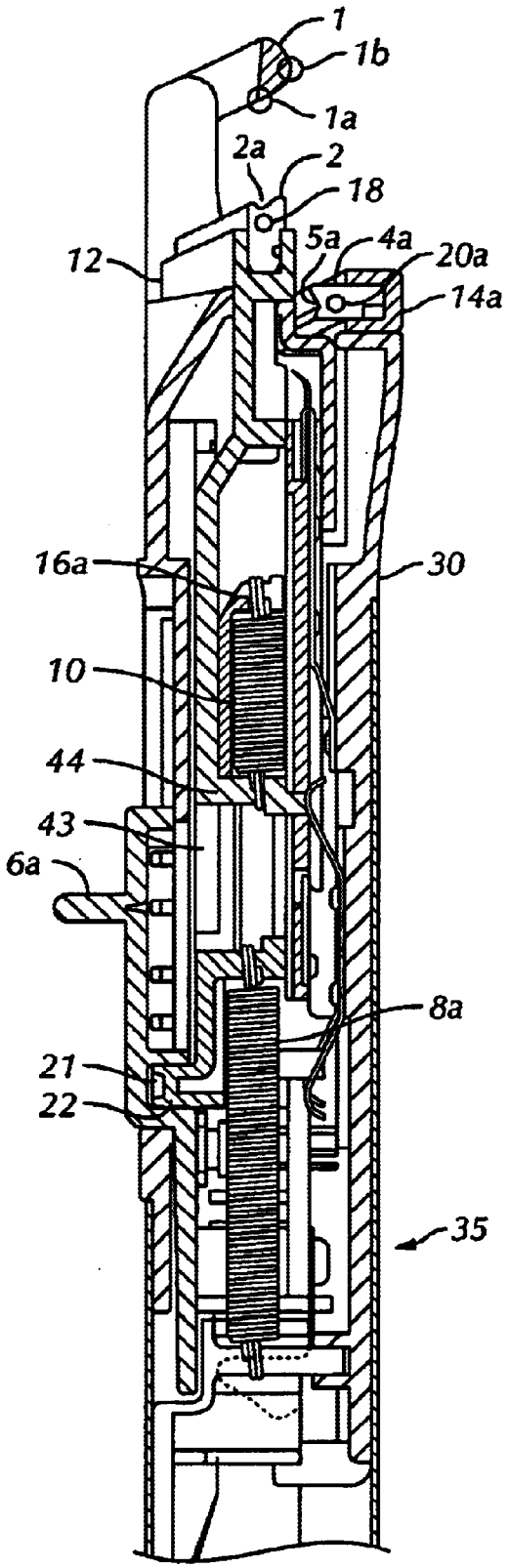
FIG. 19 is an expanded view of an important part of the eyelash curler shown in FIG. 18.
Figure 20:
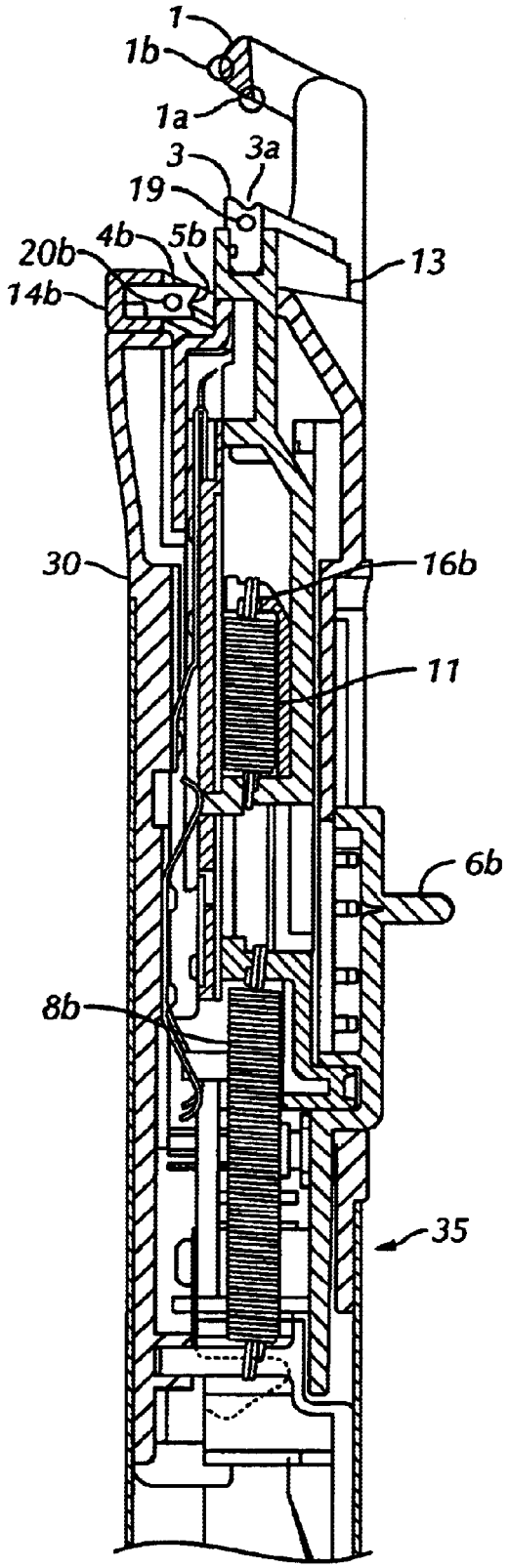
FIG. 20 is a cross sectional view of the eyelash curler shown in FIG. 16(*a*) cut by B'—B' line.

As shown in FIG. 19 and FIG. 20, the left first sandwiching-holding member 2 and right first sandwiching-holding member 3 are respectively provided with the grooves 2*a* and 3*a* with a V-shaped cross section that are laterally continuous when the left first sandwiching-holding member 2 and the right first sandwiching-holding member 3 are lined up. These grooves 2*a* and 3*a* fit into a protuberance 1*a* formed at the bottom of the immobilizing member 1. By this means, the eyelash from the hair base part to the hair intermediate part is curled by sandwiching it between the protuberance la and the grooves 2*a* and 3*a* of the left first sandwiching-holding member 2 and the right first sandwiching-holding member 3. Here, the V-shaped grooves 2*a* and 3*a* have rounded groove bottoms rather than acute angles so that a rounded curl can be imparted to the eyelashes along the grooves 2*a* and 3*a* without imparting an acute-angle shape. The left second sandwiching-holding member 4*a* and the right second sandwiching-holding member 4*b* are provided with grooves 5*a* and 5*b* with V-shaped cross section respectively. The grooves 5*a* and 5*b* are laterally continuous when the left second sandwiching-holding member 4*a* and the right second sandwiching-holding member 4*b* are lined up. These grooves 5*a* and 5*b* engage with the protuberance 1*b* formed at the back-surface side of the immobilizing member 1. By this means, the eyelash from the hair intermediate part to the hair tip of the eyelashes is curled by sandwiching it between the protuberance 1*b* and the grooves 4*a* and 4*b* of the left second sandwiching-holding member 4*a* and the right second sandwiching-holding member 4*b*. Here, the grooves 5*a* and 5*b* may also have a rounded bottom.

Here, the immobilizing member 1 may be formed from rigid material such as metal, plastic, or the like. Also, the left first sandwiching-holding member 2, the right first sandwiching-holding member 3, the left second sandwiching-holding member 4*a,* and the right second sandwiching-holding member 4*b* may be formed from elastic material. Therefore, it becomes possible to increase pressure of the eyelashes against the immobilizing member 1 and to more readily curl the eyelashes.

The left first sandwiching-holding member 2 contains internally a left first heater 18 formed from a coil-shaped nichrome. The right first sandwiching-holding member 3 contains the right first heater 19 in the same manner. In addition, the left second sandwiching-holding member 4*a* internally contains a left second heater 20*a* formed from coil-shaped nichrome wire, and the right second sandwiching-holding member 4*b* contains a right second heater 20*b* in the same manner. A dry cell battery 50 contained within the eyelash curler main body 30 is connected to this left first heater 18, the right first heater 19, the left second heater 20*a,* and right second heater 20*b* so that eyelashes can be readily and dependably curled by heating. A heater formed from coil-shaped nichrome wire may also be provided within the immobilizing member 1 to make it possible to perform eyelash curling more readily and dependably.

While the eyelash curler 35 of the present embodiment is constructed with right-left symmetry around centerline C' as described above, the description below discusses the configuration for performing eyelash curling by moving the left first sandwiching-holding member 2 and the left second sandwiching-holding member 4*a* upward in accompaniment with operation of the left operating handle 6*a* at the left side of the eyelash curler 35.

Figure 21:
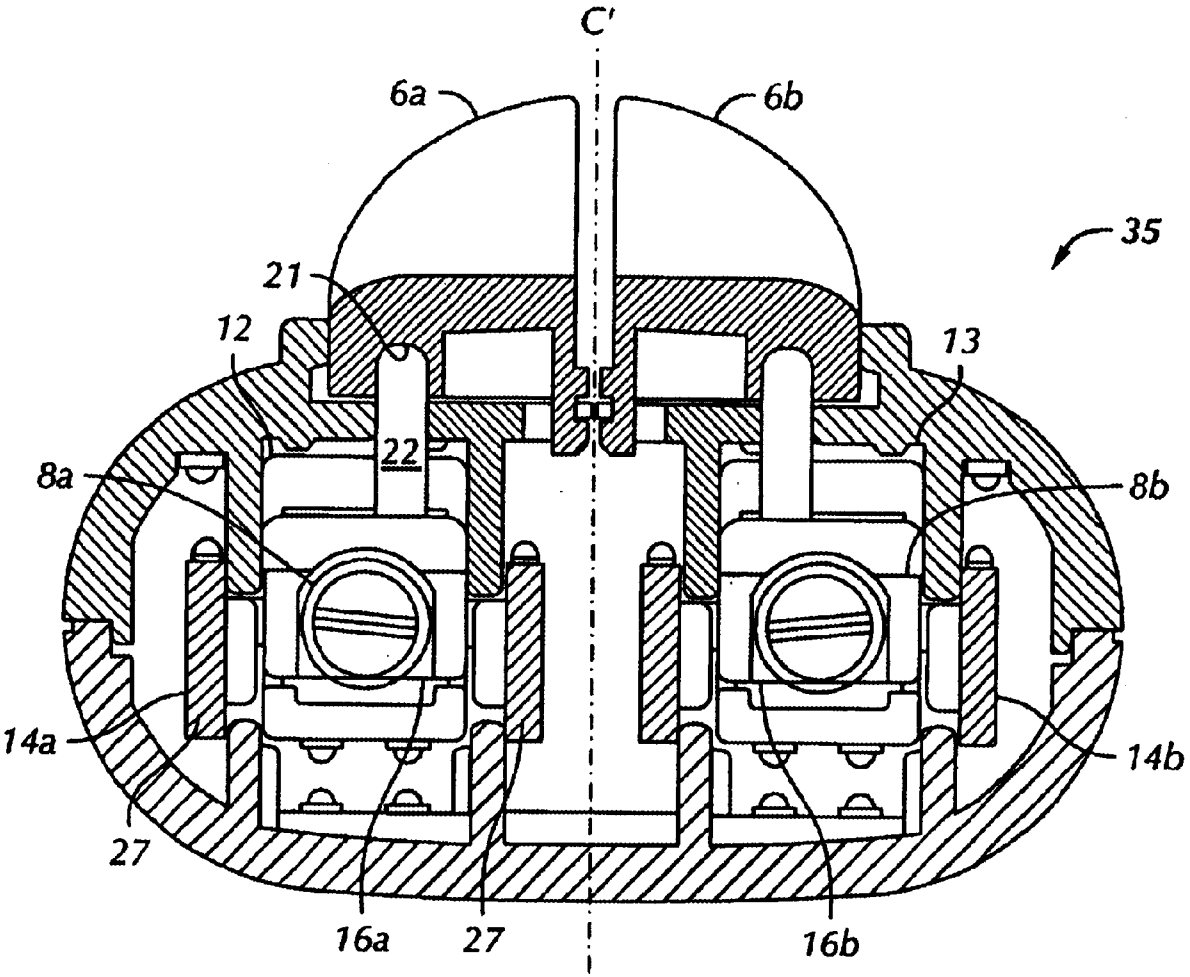
FIG. 21 is a cross sectional view of the eyelash curler shown in FIG. 16(*a*) cut by D'—D' line.
Figure 23:
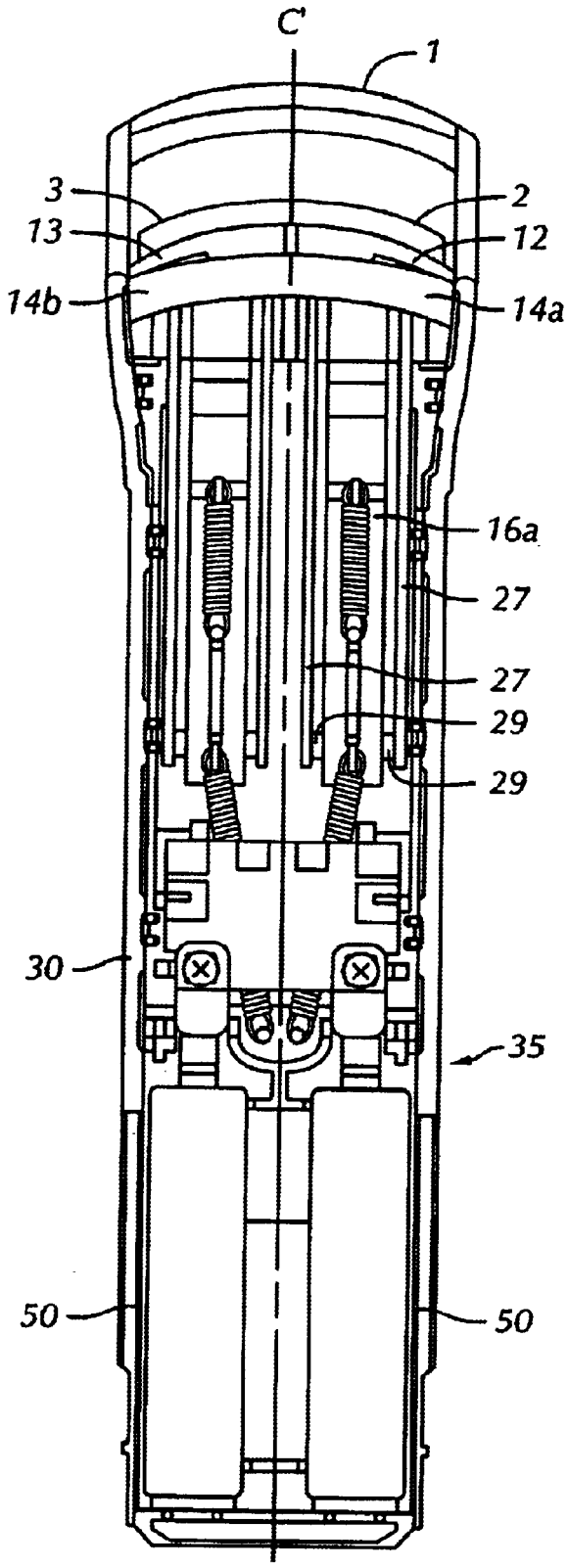
FIG. 23 is a rear view of another embodiment of the eyelash curler of the present invention from which a part of the cover is removed.

The slide knob 16*a* is stored within the left side of the eyelash curler main body 30 so as to move freely vertically. As shown in FIG. 19 and FIG. 21, a joint 22 provided on this slide knob 16*a* links together with a cover joint 21 provided on the left operating handle 6*a*. The left slide knob 16*a* moves vertically freely in accompaniment with vertical sliding of the left operating handle 6*a*. A left first spring 8*a* connects the bottom of the left slide knob 16*a* and the eyelash curler main body 30 so as to retain initial tension. Moreover, a vertically extending central opening 43 is provided in the left slide knob 16*a*. A bottom lateral tab 44 is provided at the lower part of the left first holder 12 which is inserted so as to move freely vertically within this aperture 43. The lower lateral tab 44 and upper part of the left slide knob 16*a* are linked together by the left second spring 10 which retains initial tension. The left first spring 8*a* and the left second spring 10 may be formed with any elastic material such as rubber, etc. Respective downwardly hanging arms 27 are provided at both side of the left second holder 14*a* as shown in FIG. 23. These arms 27 are linked to the left slide knob 16*a* by an arm 29 as shown in FIG. 23.

Figure 22A:
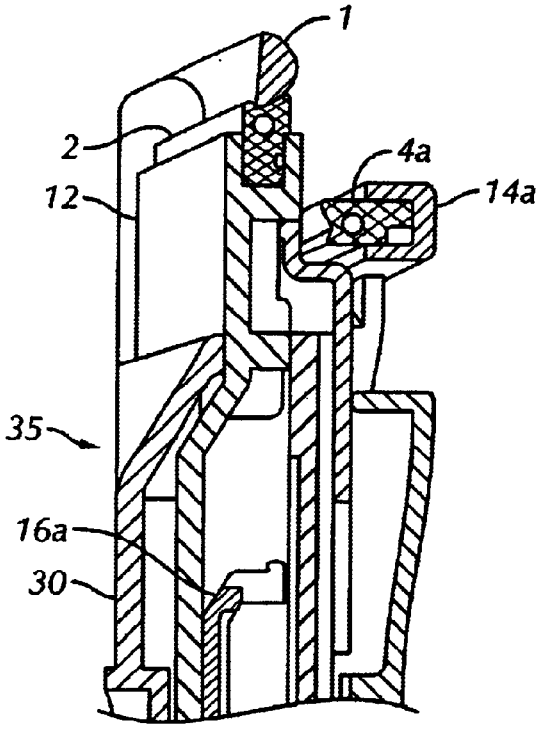
FIG. 22(*a*) shows a state of the eyelash curler shown in FIG. 16(*a*) where only the left first sandwiching-holding member pressing against the immobilizing member.
Figure 22B:
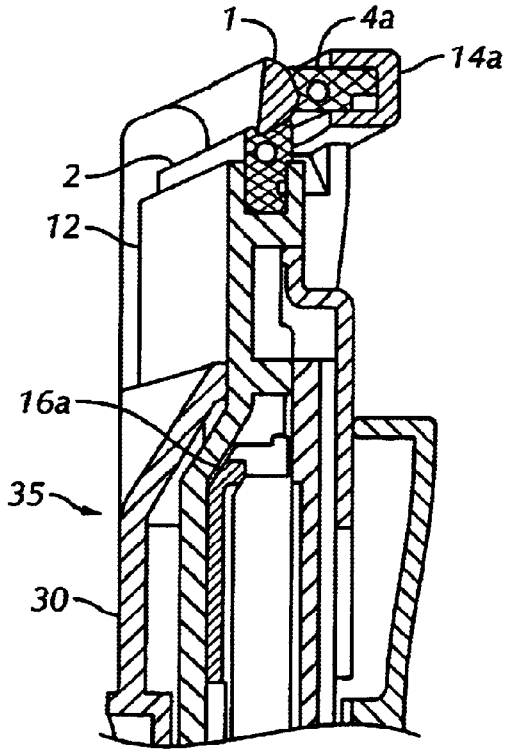

When the left operating handle 6*a* is moved upward, the left first holder 12 is moved upward by the left second spring 10 due to upward movement of the left slide knob 16*a,* and the left first sandwiching-holding member 2 attached to the upper tip of the left first holder 12 is pressed over the eyelashes from the hair base part to the hair intermediate part against the lower side of the immobilizing member 1. Moreover, since the left slide knob 16*a* and the left first holder 14*a* are connected together, upward movement of the left operating handle 6*a* also causes accompanying upward movement of the second left holder 14*a*. Here, as shown in FIG. 22(*a*), the left operating handle 6*a* is moved upward up until the eyelashes are sandwiched and held from the hair base part to the hair intermediate part of the eyelashes by pressing of the left first sandwiching-holding member 2 against the immobilizing member 1. In this operation, the left first sandwiching-holding member 2 and the left second sandwiching-holding member 4*a* are move upward in concert. And if the left operating handle 6*a* is moved further upward after the left first sandwiching-holding member 2 contacted with the immobilizing member 1, the left second holder 14*a* connected to the left slide knob 16*a* is moved further upward while sandwiching the eyelashes from the hair base part to the hair intermediate part of the eyelashes against the immobilizing member 1 due to the tension of the left second spring 10. Therefore, at a region beyond a certain range, only the left second sandwiching-holding member 4*a* is moved upward and pushes against the side of the immobilizing member 1 as shown in FIG. 22(*b*). Therefore, the eyelash tip part from the hair intermediate part to the hair tip of the eyelashes is sandwiched and held between the backside surface of the immobilizing member 1 and the left second holding member 4*a*. Curling of eyelashes from the hair base part to the hair tip is performed in this manner.

In this case, due to tension held by the left first spring 8*a* and the left second spring 10, operability by the user is good since the left first sandwiching-holding member 2 and the left second sandwiching-holding member 4*a* automatically separate from the immobilizing member 1 when the finger is released from the left operating handle 6*a*. In this manner, it becomes possible for a user to smoothly perform eyelash curling by grasping grip 31 of the eyelash curler main body 30 by hand, pressing the operating handle 6*a* upward, and then just releasing the finger from the operating handle 6*a*.

Although construction was described of the left side of the eyelash curler 35 split by centerline C' of the present embodiment, the right side as shown in FIG. 20 is constructed with right-left symmetry and so further comprises the right first sandwiching-holding member 3, the right second sandwiching-holding member 4*b,* the right operating handle 6*b,* the right first holder 13, the right second holder 14*b,* the right slide knob 16*b,* the right first spring 8*b,* and the right second spring 11.

Figures 17A, 17B, 17C:
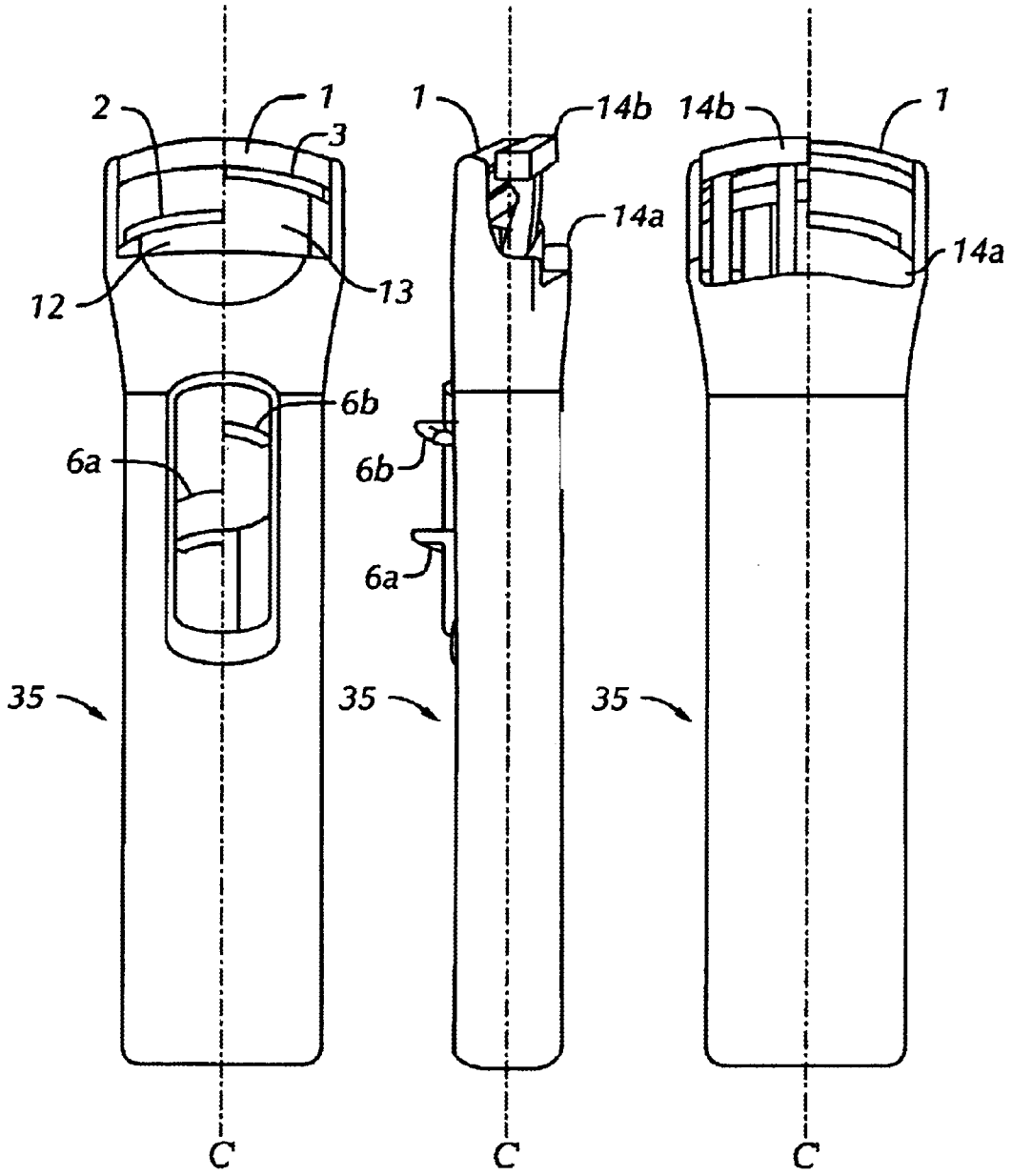
FIG. 17(*a*) is a front view of an eyelash curler according to another embodiment of the present invention.
Figure 18:
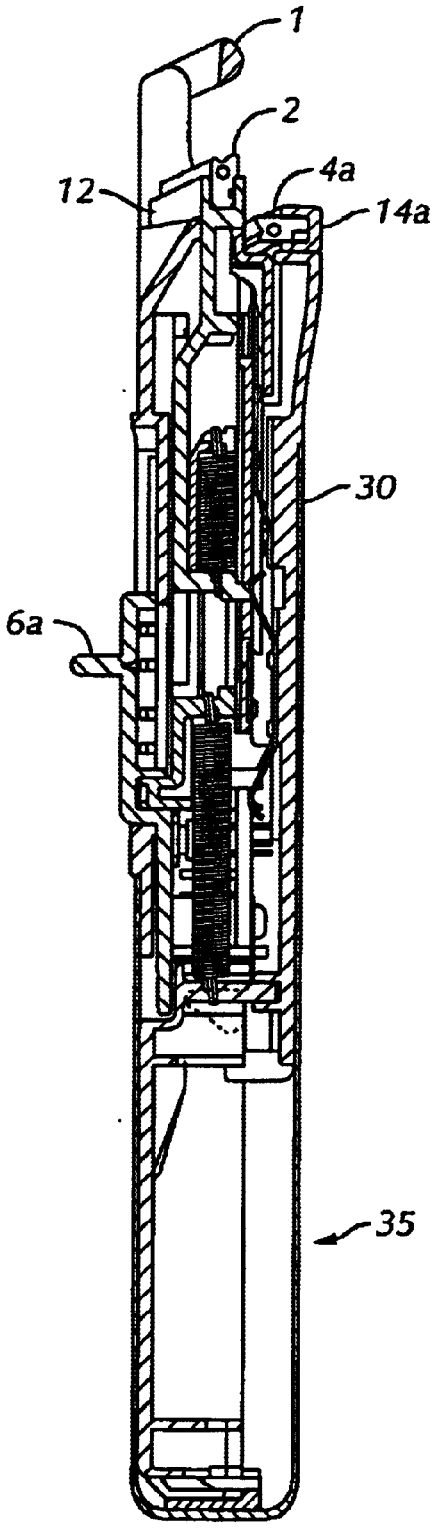
FIG. 18 is a cross sectional view of the eyelash curler shown in FIG. 16(*a*) cut by A'—A' line.

Due to the entirely independent construction of the left side and right side, right-left independent operation (i.e., performance of eyelash curling of the part of the eyelashes sandwiched between the immobilizing member 1 and the left first sandwiching-holding member 2 and the left second sandwiching-holding member 4*a* due to by raising of the left first holder 12 and the left second holder 14*a* due to operation of the left operating handle 6*a,* or eyelash curling of the part of the eyelashes sandwiched between the immobilizing member 1 and the right first sandwiching-holding member 3 and the right second sandwiching-holding member 4*b* due to raising of the right first holder 13 and the right second holder 14*b* due to operation of the right operating handle 6*a* as shown in FIG. 17) can be readily carried out for localized curling of a spot such as at the inner or outer corner of the eye. The left operating handle 6*a* and right operating handle 6*b* can also be simultaneously operated so that a curl can be imparted to all eyelashes in a single operation.

According to an embodiment of the present invention, curling of all eyelashes can be carried out simultaneously in a single operation by movement of the entire segmented sandwiching-holding member. Also, if each sandwiching-holding member segment is moved independently, it becomes possible to curl a localized part (i.e., at the inner corner or outer corner of the eye) by sandwiching between the various sandwiching-holding member segments. This therefore has the effect of providing good operability for the user during the eyelash curling operation. Under this configuration, overall eyelash curling or localized eyelash curling can be selected and carried out by using a single eyelash curler without the need for possession of multiple types of eyelash curlers. And if curvature of the immobilizing member does not match that of the eye of the user, localized curling can be performed by using the right or left segmented sandwiching-holding member segment without the troublesome procedure of curling while gradually shifting the eyelash curler.

According to an embodiment of the present invention, various types of curling such as curling of all the eyelashes or localized curling of part of the eyelashes (i.e., at the inner corner or outer corner of the eye) can be performed in a simple and reliable manner by simply toggling the mode-switching switch.

According to an embodiment of the present invention, a user can avoid mistakenly switching the mode-switching switch during operation of the operating handle.

According to an embodiment of the present invention, it becomes possible to easily recognize the operating position of the mode-switching switch for operation of the desired sandwiching-holding member segment.

According to an embodiment of the present invention, inadvertent operation of an undesired sandwiching-holding member during use can be prevented and it becomes possible to achieve reliable use.

According to an embodiment of the present invention, it becomes possible to perform curling of eyelashes while holding the eyelashes tightly and reliably.

According to an embodiment of the present invention, erroneous operation of the mode-switching switch caused by contact with a finger during use can be prevented.

According to an embodiment of the present invention, because the gap between sandwiching-holding member segments is closed by a protuberance, pinching and pulling of eyelashes can be effectively prevented.

According to an embodiment of the present invention, because the protuberance can be elastically deformed, stoppage of contact and separation movement of the sandwiching-holding member can be prevented even when interference occurs between the protuberance and the side surface of the adjacent sandwiching-holding member when the eyelash curler is under the separate operation mode.

According to an embodiment of the present invention, it becomes possible to perform effective curling of the eyelash from the hair base to the hair tip in a single operation.

According to an embodiment of the present invention inadvertent curling by the second sandwiching-holding member of the eyelash tip part which isn't held between the sandwiching-holding member and the immobilizing member can be prevented.

According to an embodiment of the present invention, it becomes possible to readily view operation of the sandwiching-holding member in a mirror, etc. and easily perform fine corrections.

According to an embodiment of the present invention, it becomes possible to perform more effective curling by heating the eyelashes while the eyelashes are sandwiched against the immobilizing member.

According to an embodiment of the present invention, it becomes possible to quickly discover equipment failure or lack of batteries by indication of current flow to the heater during operation.

According to an embodiment of the present invention, it becomes to easily recognize which sandwiching-holding member segment is being used.

According to an embodiment of the present invention, it becomes possible to know when batteries have become exhausted and should be replaced.

According to an embodiment of the present invention, it becomes possible to perform curling of a localized part of the eyelashes (e.g., at the inner corner or outer corner of the eye) by operation of the various divided operating handles, and such construction makes it possible to perform all-eyelashes curling by simultaneous operation of each divided operating handle.

According to an embodiment of the present invention it becomes possible to curl the entire eyelash from the hair base to the hair tip of the eyelashes simultaneously if the divided sandwiching-holding member segments and the entire second sandwiching-holding member are simultaneously moved and of also making it possible to effectively curl from the hair base to the hair tip by sandwiching just a localized part of the eyelashes (i.e., at the inner or outer corner of the eye) if the sandwiching-holding member and the corresponding second sandwiching-holding member are moved independently.

According to an embodiment of the present invention, it becomes possible to perform effective curling by heating the eyelashes while the eyelashes are sandwiched against the immobilizing member.

While the present invention has been described with respect to a limited number of preferred embodiments, those skilled in the art will appreciate numerous modifications and variations therefrom. The appended claims are intended to cover all such modifications and variations which occur to one of ordinary skill in the art.

What is claimed is:

1. An eyelash curler, comprising:

a curler main body;

an immobilizing member attached to a top of the curler main body for immobilizing eyelashes;

a plurality of first sandwiching-holding members attached to the curler main body underneath the immobilizing member at a predetermined distance therefrom and adapted to sandwich the eyelashes against the immobilizing member, wherein each of the plurality of first sandwiching-holding members is positioned laterally adjacent to one another and independently pressed against and released from the immobilizing member; and an operating handle attached to the curler main body for causing the plurality of first sandwiching-holding members to sandwich the eyelashes against the immobilizing member.

2. The eyelash curler according to claim 1, wherein the plurality of first sandwiching-holding members comprise a left first sandwiching-holding member and a right first sandwiching-holding member.

3. The eyelash curler according to claim 1, further comprising a mode-switching toggle switch attached to the curler main body for switching between a plurality of operation modes of the eyelash curler, the operation modes comprising:

a single operation mode wherein the plurality of first sandwiching-holding members are pressed against and released from the immobilizing member altogether by toggling the operation handle when the mode-switching toggle switch is toggled into a single operation mode position; and a separate operation mode wherein one of the plurality of first sandwiching-holding members selected by the mode-switching toggle switch is pressed against and released from the immobilizing member independently from other first sandwiching-holding members by toggling the operation handle when the mode-switching toggle switch is toggled into a separate operation mode position.

4. The eyelash curler according to claim 3, wherein the operation handle is operated by manually sliding the operation handle in one direction and the mode-switching toggle switch is operated by manually toggling the toggle switch in another direction that is perpendicular to the sliding direction of the operation handle.

5. The eyelash curler according to claim 3, wherein the mode-switching toggle switch is disposed at a position on the curler main body such that the operating handle is positioned between the immobilizing member and the mode-switching toggle switch.

6. The eyelash curler according to claim 3, wherein operation modes of the eyelash curler are selected by toggling the mode-switching toggle switch into a plurality of different positions thereon, and upon toggling the mode-switching toggle switch into a separate operation mode position, a first sandwiching-holding member disposed at a position that corresponds to the separate operation mode position becomes operable by the operation handle.

7. The eyelash curler according to claim 3, further comprising a mechanism attached to the curler main body for fixing one of the plurality of first sandwiching-holding members that is not operable by the operation handle under the separate operation mode at a position distant from the immobilizing member.

8. The eyelash curler according to claim 3, further comprising a mechanism for fixing a first sandwiching-holding member that is operable under the separate operation mode at a condition wherein the first sandwiching-holding member is contacted with the immobilizing member.

9. The eyelash curler according to claim 3, further comprising a mechanism for fixing the mode-switching toggle switch at a separate operation mode position during a time when one of the plurality of first sandwiching-holding member is sandwiching the eyelashes against the immobilizing member under the separate operation mode.

10. The eyelash curler according to claim 1, wherein each of the first sandwiching-holding members is provided with a protuberance that protrudes toward an adjacent first sandwiching-holding member.

11. The eyelash curler according to claim 10, wherein the protuberance is formed of an elastic material.

12. The eyelash curler according to claim 10, wherein the protuberance is formed in a thin-walled shape.

13. The eyelash curler according to claim 1, further comprising a second sandwiching-holding member attached to the curler main body underneath the immobilizing member at a predetermined distance therefrom, the second sandwiching-holding member adapted to sandwich a top end portion of the eyelashes against the immobilizing member when the eyelashes are sandwiched between the first sandwiching-holding member and the immobilizing member.

14. The eyelash curler according to claim 3, further comprising a second sandwiching-holding member attached to the curler main body underneath the immobilizing member at a predetermined distance therefrom, the second sandwiching-holding member adapted to sandwich a top end portion of the eyelashes against the immobilizing member when the eyelashes are sandwiched between the first sandwiching-holding member and the immobilizing member.

15. The eyelash curler according to claim 14, wherein the second sandwiching member can be pressed against and released from the immobilizing member by toggling the operation handle only when the eyelash curler is under the single operation mode.

16. The eyelash curler according to claim 14, further comprising a mechanism for preventing the second sandwiching-holding member from getting close to the immobilizing member beyond a predetermined distance therefrom when the eyelash curler is under the separate operation mode.

17. The eyelash curler according to claim 1, further comprising a heater contained in at least one of the plurality of first sandwiching-holding members.

18. The eyelash curler according to claim 13, further comprising a heater contained in the second sandwiching-holding member.

19. The eyelash curler according to claim 13, further comprising a plurality of heaters contained in the first sandwiching-holding member and the second sandwiching-holding member.

20. The eyelash curler according to claim 1, further comprising a current ON lamp attached to the curler main body for indicating whether current is conducted through the first sandwiching-holding member.

21. The eyelash curler according to claim 13, further comprising a current ON lamp attached to the curler main body for indicating whether current is conducted through the second sandwiching-holding member.

22. The eyelash curler according to claim 1, wherein intensity of the light emitted from the current ON lamp is decreased as the voltage of the current conducted through the heater is dropped.

23. An eyelash curler, comprising:

a curler main body;

an immobilizing member attached to a top of the curler main body for immobilizing eyelashes;

a plurality of first sandwiching-holding members attached to the curler main body underneath the immobilizing member at a predetermined distance therefrom and adapted to sandwich the eyelashes against the immobilizing member, wherein each of the plurality of first sandwiching-holding members is positioned laterally adjacent to one another and independently pressed against and released from the immobilizing member; and a plurality of operating handles for causing the plurality of first sandwiching-holding members to sandwich the eyelashes against the immobilizing member;

wherein each of the plurality of operation handles causes a different first sandwiching-holding member to sandwich the eyelashes against the immobilizing member independently.

24. The eyelash curler according to claim 23, wherein each of the plurality of first sandwiching-holding member and the plurality of second sandwiching-holding member contains a heater therein.

* * * * *